US006577061B2

(12) United States Patent
Sano et al.

(10) Patent No.: US 6,577,061 B2
(45) **Date of Patent: *Jun. 10, 2003**

(54) SURFACE DISCHARGE TYPE PLASMA DISPLAY PANEL WITH BLUE LUMINESCENT AREA SUBSTANTIALLY WIDER THAN RED AND GREEN LUMINESCENT AREAS

(75) Inventors: Ko Sano, Tokyo (JP); Takayoshi Nagai, Tokyo (JP); Shinichiro Nagano, Tokyo (JP); Kanzou Yoshikawa, Tokyo (JP); Takeo Saikatsu, Tokyo (JP); Toyohiro Uchiumi, Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/255,787

(22) Filed: Feb. 23, 1999

(65) Prior Publication Data

US 2002/0180354 A1 Dec. 5, 2002

(30) Foreign Application Priority Data

Feb. 23, 1998 (JP) ..... 10-040576
Jan. 12, 1999 (JP) ..... 11-005342

(51) Int. Cl.[7] ..... H01J 11/00; H01J 11/02

(52) U.S. Cl. ..... 313/582; 313/584; 313/586; 313/587

(58) Field of Search ..... 313/581, 582, 313/584, 586, 587; 345/37, 41, 60

(56) References Cited

U.S. PATENT DOCUMENTS

| | | | | |
|---|---|---|---|---|
| 5,661,500 A | | 8/1997 | Shinoda et al. | |
| 5,754,003 A | * | 5/1998 | Murai et al. | 313/582 |
| 6,034,657 A | * | 3/2000 | Tokunaga et al. | 345/60 |

FOREIGN PATENT DOCUMENTS

| | | | | |
|---|---|---|---|---|
| JP | 7 160218 | | 6/1995 | |
| JP | 8-190869 | | 7/1996 | |
| JP | 10 188819 | | 7/1998 | |
| JP | 10 255666 | | 9/1998 | |
| JP | 410255666 A | * | 9/1998 | 313/582 |
| JP | 10 308179 | | 11/1998 | |
| JP | 410308179 A | * | 11/1998 | 313/582 |
| WO | WO 0036626 | | 6/2000 | |

* cited by examiner

*Primary Examiner*—Ashok Patel
(74) *Attorney, Agent, or Firm*—Birch, Stewart, Kolasch & Birch, LLP

(57) ABSTRACT

Of three primary color phosphors (38) formed in unit luminescent areas (EU) constituting a pixel (EG), the width of a blue phosphor (38B) is about twice the width of red and green phosphors (38R, 38G). This allows a white color temperature of 9300 K without causing deterioration of the phosphors (38) and degrading red and green gradations.

28 Claims, 31 Drawing Sheets

22j
EX
EY1
EY2
EYn
0V
Vaw
Va
n2
ADDRESS PULSE
Va+Vw
n4
C
n3
SUSTAIN PULSE
-Vy
SCAN PULSE
n1
a b c d e
TIME
RESET PERIOD
ADDRESS PERIOD
DISCHARGE SUSTAIN (DISPLAY) PERIOD
ONE SUBFIELD

SURFACE DISCHARGE TYPE PLASMA DISPLAY PANEL WITH BLUE LUMINESCENT AREA SUBSTANTIALLY WIDER THAN RED AND GREEN LUMINESCENT AREAS

BACKGROUND OF THE INVENTION

1. Field of the Invention

The present invention relates to a plasma display device and a plasma display panel, especially suitable for an image display with a high color temperature.

2. Description of the Background Art

FIG. 29 is a block diagram of a plasma display device disclosed for example in U.S. Pat. No. 5,661,500. In FIG. 29, the reference numeral 100 designates a plasma display device; 1 is a plasma display panel (hereinafter referred to as "PDP") including display electrodes EX and EY (hereinafter referred to as "X electrode EX" and "Y electrode EY") that induce display discharge in a space therebetween, and address electrodes (hereinafter referred to as "A electrode"); 110 is a scan control unit; 120 is an A/D converter (hereinafter referred to as "A/D") converting input signals from analog to digital; 130 is a frame memory storing the output of the A/D 120; 141 is an X-electrode driving circuit for supplying a driving signal to the X electrodes EX of the PDP 1; 142 is a Y-electrode driving circuit for supplying a driving signal to the Y electrodes EY of the PDP 1; 143 is an A-electrode driving circuit for supplying a driving signal to the A electrodes of the PDP 1; 2 is a driving control system comprising the X-electrode driving circuit 141, the Y-electrode driving circuit 142, and the A-electrode driving circuit 143.

We will now describe a method for driving the plasma display device 100.

FIGS. 30A through 30E are timing charts showing an example of waveforms of applied voltages during one subfield according to a subfield gradation technique, disclosed for example in Japanese Patent Laid-open No. 7-160218A.

In FIGS. 30A through 30E, n1 is a scan pulse; n2 is an address pulse; n3 is a sustain pulse; and n4 is a priming pulse (full writing pulse).

One subfield is divided into: (1) a reset period to erase wall charges; (2) an address period to store wall charges in cells that emit lights for display; and (3) a sustain discharge period to induce sustain discharge in the cells where the wall charges are stored during the address period, to produce light emissions for display.

In the reset period, the full writing pulse n4 is applied to the sustain electrode EX to induce discharge in all cells. The full writing pulse n4 may also be referred to as "priming pulse". At the falling edge of the full writing pulse n4, self-erase discharge is induced in all the cells to erase wall charges.

In the address period, the scan pulse n1 is sequentially applied to the Y electrodes EY1 to EYn, and the address pulse n2 is applied to the A electrodes 22*j*. This induces address discharge in cells to be lightened for display during the display period, and wall charges are stored in the surface of a protective layer 18 of those cells.

In the sustain discharge period, the sustain pulse n3 is alternately applied to the Y electrodes EYi (i=1 to n) and the X electrode EX to induce sustain discharge only in the cells where the address discharge occurs.

FIG. 31 a perspective view showing the structure of a conventional PDP 1 disclosed for example in U.S. Pat. No. 5,661,500. In FIG. 31, the reference number 11 designates a front or first substrate; 17 is a dielectric layer covering the X electrode EX and the Y electrode EY which will be described later; 18 is a protective layer formed for example of MgO and covering the surface of the dielectric layer 17; 22 is the A electrode; 21 is a rear or second surface; 28 is an uninterrupted phosphor stripe formed along the A electrode 22; 29 is a barrier rib provided on the side of the second substrate 21; 30 is a discharge space; 41 is a strip transparent conductive film (hereinafter referred to as "transparent electrode") which is formed of a tin oxide layer, etc. and disposed in parallel with each other at given intervals (discharge gap) to form the X electrode EX and the Y electrode EY; and 42 is a strip metal film (hereinafter referred to as "metal electrode") formed of a multilayer film such as Cr—Cu—Cr or Cr—Al—Cr to supplement conductivity of the transparent electrode 41. Each of the X electrode EX and the Y electrode EY is composed of the transparent electrode 41 and the additional metal electrode 42. The reference character EG designates a pixel, which is, in the case of color display devices, composed of unit luminescent areas EU emitting lights of a plurality of colors. The reference character S designates a display surface.

Next, we will describe operation of the conventional plasma display device. The plasma display device 100 comprises the PDP 1 and the driving control system 2 for driving the PDP 1, electrically connected to the PDP 1 via a flexible printed wiring board. In the driving control system 2, an analog input signal is converted into a digital form by the A/D 120; the digital output from the A/D 120 is stored in the frame memory 130 as a digital image signal; and according to the digital image signal, the output of the scan control unit 110 is supplied to the X-electrode driving circuit 141, the Y-electrode driving circuit 142, and the A-electrode driving circuit 143 to drive the PDP 1.

The PDP 1 is a surface discharge type PDP with a three electrode structure having a pair of display electrodes, namely X electrode EX and Y electrode EY, and the A electrode which correspond to the unit luminescent area EU. Both the X electrode EX and the Y electrode EY are composed of the transparent electrode 41 and the metal electrode 42 and disposed on a surface of the first substrate 11 on the side of the display surface S. On the second substrate 21, the barrier ribs 29 are provided, defining the height of the discharge space 30. The discharge space 30 is sectioned by the unit luminescent areas EU along an extending direction of the X and Y electrodes EX and EY (hereinafter referred to as "first direction").

Between the parallel barrier ribs 29, an A electrode of a given width is disposed by printing and firing a pattern of a silver paste; and a phosphor stripe 28 is provided to cover side walls of the barrier ribs 29 and the second substrate 21 including the surface of the A electrode 22. The pixel EG is almost in the shape of a square, composed of three unit luminescent areas EU(28R), EU(28G), EU(28B) (generically referred to as "unit luminescent area EU") which are approximately similar rectangles in shape and correspond to the emitted colors: red (R), green (G), and blue (B), respectively. That is, the unit luminescent area EU of each emitted color in the pixel EG is about the same in width in the first direction D1, constituting one third the width of the pixel in the first direction D1.

To prevent deterioration in contrast of the screen due to incident extraneous lights from the first substrate 11 of the PDP 1, a black low melting point glass (black stripe) may be provided between the pair of the X electrode EX and the Y electrode EY on the first substrate 11.

FIG. 32 is a schematic diagram showing an arrangement of phosphors viewed from the display surface S. As shown in FIG. 32, a pixel EG is basically composed of the unit luminescent areas EU with a red phosphor 28R, a green phosphor 28G, and a blue phosphor 28B (each alphabet designates the emitted color and the aforementioned phosphor 28 is a generic name for these three phosphors) corresponding to three primary colors: red (R), green (G), and blue (B), respectively. Color reproduction is thus made by additive mixing of color lights emitted from the unit luminescent areas EU corresponding to the three primary colors. For instance, the red phosphor 28R is formed of (Y, Gd) $BO_3:EU^{3+}$; the green phosphor 28G of $Zn_2SiO_4:Mn$; and the blue phosphor 28B of $BaMgAl_{14}O_{23}:Eu^{2+}$.

The composition of materials of the phosphors is selected so that a mixture of the three colors becomes white (somewhat reddish white) when light emissions (excitation) from all the unit luminescent areas occurs simultaneously under the same conditions. Under normal circumstances, the white color temperature of approximately 6000 K is accomplished.

The aforementioned conventional plasma display panel has the following problems.

In order to obtain a so-called white color display with a high color temperature about 9300 K, i.e., a bluish white image with a high color temperature, the intensity of blue light emission has to be increased (to as much as the luminescence intensity of red). In the conventional device, however, the luminescent area of blue is about the same in size as the other luminescent areas of red and green as shown in FIG. 32, so that the luminescence intensity of blue is relatively low according to the properties of phosphors. Accordingly, the white display has a low color temperature.

For the purpose of relatively increasing the luminescence intensity of blue, it may be considered to increase the levels of blue gradations larger than those of red and green gradations or to reduce the levels of red and green gradations smaller than those of the blue gradations. However, reducing the levels of the red and green gradations (e.g., reducing 256-level red and green gradation to 128-level while maintaining a 256-level blue gradation) narrows down the representation of the red and green gradations, which interferes good color-image display. Further, if the amount of ultraviolet rays irradiating the blue phosphor is increased as compared with that irradiating the red and green phosphors in order to increase the amount of blue light emission, the blue phosphor will be deteriorated more than the red and green phosphors.

SUMMARY OF THE INVENTION

A first preferred embodiment of the present invention is directed to a surface discharge type plasma display panel comprising: a first substrate; a plurality of display electrode pairs formed on an inner surface of the first substrate in a first direction; a second substrate with a plurality of address electrodes formed in a second direction intersecting with the first direction, the second substrate and the first substrate sandwiching a discharge space therebetween; a plurality of phosphors provided for each of the plurality of address electrodes to emit a plurality of emitted colors; and a plurality of barrier ribs extending in the second direction on the second substrate and spaced in the first direction so that a substantial space corresponding to at least any one emitted color out of the plurality of emitted colors is different from a space corresponding to the other emitted colors, each of the plurality of barrier ribs having side walls on which each of the plurality of phosphors are deposited.

According to a second aspect of the present invention, in the surface discharge type plasma display panel of the first aspect, the second substrate comprises: a second substrate body; the plurality of address electrodes formed on the second substrate body; and a dielectric formed on the second substrate and on the plurality of address electrodes to cover the plurality of address electrodes, and the plurality of barrier ribs are formed on a surface of the dielectric.

According to a third aspect of the present invention, in the surface discharge type plasma display panel of the second aspect, the plurality of emitted colors include red, green, and blue.

According to fourth aspect of the present invention, in the surface discharge type plasma display panel of the third aspect, the any one emitted color is blue.

According to a fifth aspect of the present invention, the surface discharge type plasma display panel of the first aspect is composed of a plurality of pixels each including unit luminescent areas each corresponding to each of the plurality of emitted colors, wherein a substantial space between barrier ribs corresponding to the any one emitted color is larger than one third the width of any one pixel out of the plurality of pixels in the first direction.

According to a sixth aspect of the present invention, the surface discharge type plasma display panel of the first aspect is composed of a plurality of pixels each including unit luminescent areas each corresponding to each of the plurality of emitted colors, wherein a substantial space between barrier ribs corresponding to the any one emitted color is about a half of a space between barrier ribs corresponding to a given emitted color other than the any one emitted color.

According to a seventh aspect of the present invention, in the surface discharge type plasma display panel of the first aspect, the plurality of emitted colors include red, green, and blue; a phosphor of the red, a phosphor of the green, and a phosphor of the blue are defined as "R", "G", and "B", respectively; a single pixel is composed of four unit luminescent areas; and phosphors in the single pixel are arranged in order of R, B, G, B in the first direction.

According to an eighth aspect of the present invention, in the surface discharge type plasma display panel of the first aspect, the plurality of emitted colors include red, green, and blue; a phosphor of the red, a phosphor of the green, and a phosphor of the blue are defined as "R", "G", and "B", respectively; a single pixel is composed of four unit luminescent areas; and phosphors in the single pixel are arranged in order of B, G, B, R in the first direction.

According to a ninth aspect of the present invention, in the surface discharge type plasma display panel of the first aspect, a color temperature obtained by mixing the plurality of emitted colors is approximately 9300 K or more.

A tenth aspect of the present invention is directed to a surface discharge type plasma display device comprising: the surface discharge type plasma display panel of the first aspect; and a driving control system. The driving control system comprises: display-electrode driving circuits connected to a first electrode and a second electrode, respectively, the first and second electrodes forming each of the plurality of display electrode pairs of the surface discharge type plasma display panel, the display-electrode driving circuits driving the surface discharge type plasma display panel; an address-electrode driving circuit connected to the plurality of address electrodes of the surface discharge type plasma display panel; and a control unit configured to control the display-electrode driving circuits and the address-electrode driving circuit.

According to an eleventh aspect of the present invention, the surface discharge type plasma display device of the tenth aspect, further comprises: a filter provided forward of a substrate on a display surface side of the surface discharge type plasma display panel out of the first and second substrates and having a spectrum that transmittance of each wavelength is almost uniform in a visible luminescence wavelength region.

According to a twelfth aspect of the present invention, in the surface discharge type plasma display panel of the first aspect, a substrate on a display surface side of the surface discharge type plasma display panel out of the first and second substrates is colored and has a spectrum that transmittance of each wavelength is almost uniform in a visible luminescence wavelength region.

According to a thirteenth aspect of the present invention, the surface discharge type plasma display panel of the fourth aspect, further comprises: a dielectric layer formed on the inner surface of the first substrate to cover the plurality of display electrodes; and a filter provided in a portion of the dielectric layer corresponding to a cell of the blue emitted color and having a spectrum that transmittance of a blue light wavelength is higher than transmittance of a red light wavelength.

According to a fourteenth aspect of the present invention, in the surface discharge type plasma display panel of the first aspect, a first unit luminescent area corresponding to the any one emitted color and a second unit luminescent area corresponding to one of the other emitted colors are adjacent to each other in the first direction; a space between barrier ribs defining the first unit luminescent area is larger than a space between barrier ribs defining the second unit luminescent area; one of the barrier ribs defining the first unit luminescent area corresponds to one of the barrier ribs defining the second unit luminescent area, having a first side wall on the side of the first unit luminescent area and a second side wall on the side of the second unit luminescent area; and a thickness of a first phosphor covering a portion of the first side wall in the vicinity of the inner surface of the first substrate is smaller than a thickness of a second phosphor covering a portion of the second side wall in the vicinity of the inner surface of the first substrate.

According to a fifteenth aspect of the present invention, in the surface discharge type plasma display panel of the first aspect, of the plurality of address electrodes, a width of an address electrode of an unit luminescent area corresponding to the any one emitted color in the first direction is different from widths of address electrodes of unit luminescent areas corresponding to the other emitted colors in the first direction.

According to a sixteenth aspect of the present invention, in the surface discharge type plasma display panel of the fifteenth aspect, with an increase in the substantial space between barrier ribs defining the unit luminescent area of the any one emitted color, the width of the address electrode corresponding to the any one emitted color becomes narrower than the width of the address electrodes corresponding to the other emitted colors.

According to a seventeenth aspect of the present invention, in the surface discharge type plasma display panel of the fifteenth aspect, with an increase in the substantial space between barrier ribs defining the unit luminescent area of the any one emitted color, the width of the address electrode corresponding to the any one emitted color becomes wider than the width of the address electrodes corresponding to the other emitted colors.

An eighteenth aspect of the present invention is directed to a surface discharge type plasma display panel comprising: a first substrate; a group of display electrodes formed on an inner surface of the first substrate in a first direction; a second substrate with a group of address electrodes formed in a second direction intersecting with the first direction, the second substrate and the first substrate sandwiching a plurality of discharge spaces therebetween; and a plurality of phosphors provided for each of address electrodes in the group of address electrodes, on a portion of an inner surface of the second substrate facing a discharge space corresponding to each of the address electrodes, each of the plurality of phosphors emitting lights of various colors corresponding to each of the address electrodes, wherein a substantial luminescent area corresponding to at least any one emitted color out of a plurality of emitted colors is different in size from substantial luminescent areas corresponding to the other emitted colors.

According to a nineteenth aspect of the present invention, in the surface discharge type plasma display panel of the eighteenth aspect, the emitted colors is composed of red, green, and blue; and a substantial luminescent area of the blue is larger than substantial luminescent areas of the red and the green.

A twentieth aspect of the present invention is directed to a substrate for a surface discharge type plasma display panel, comprising: a plurality of barrier ribs spaced in a first direction on a surface of the substrate and extending in parallel with each other in a second direction intersecting with the first direction; and a plurality of phosphors formed on facing side walls of adjacent barrier ribs out of the plurality of barrier ribs and on a portion of the surface of the substrate sandwiched between the adjacent barrier ribs, each phosphor emitting a light of either of a plurality of emitted colors, wherein a substantial area of a portion covered with a phosphor corresponding to at least any one emitted color out of the plurality of emitted colors is different in size from substantial areas of portions covered with phosphors corresponding to the other emitted colors.

According to a twenty-first aspect of the present invention, in the surface discharge type plasma display panel of the first aspect, of the plurality of address electrodes, the width of an address electrode of an unit luminescent area corresponding to any one emitted color out of the plurality of emitted colors in the first direction is about the same as the width of address electrodes of unit luminescent areas corresponding to the other emitted colors in the first direction.

According to a twenty-second aspect of the present invention, in the surface discharge type plasma display panel of the fifteenth aspect, each of said plurality of address electrodes except its terminal portions connected to the outside is located about at the center between adjacent barrier ribs corresponding to that address electrode out of the plurality of barrier ribs; and respective terminal portions of the plurality of address electrodes are sequentially formed at regular intervals on the end portion of the second substrate.

According to a twenty-third aspect of the present invention, in the surface discharge type plasma display device of the tenth aspect, the plurality of emitted colors is composed of at least three colors; the surface discharge type plasma display panel is composed of a plurality of pixels;

each of the plurality of pixels is composed of at least four unit luminescent areas; two of the four unit luminescent areas correspond to any one emitted color out of the plurality of emitted colors; and the address-electrode driving circuit comprises an address-electrode driving circuit board equipped with an address driver. For each pixel, of output terminals of the address driver, an output terminal of any one emitted color out of the plurality of emitted colors is electrically connected to a first end portion of a first signal line which will be branched into two branch signal lines on its way, on the address-electrode driving circuit board; and respective output terminals of the other emitted colors are electrically connected to corresponding first end portions of second signal lines which extend without intersecting with each other, on the address-electrode driving circuit board. One of the two branch signal lines forms a grade-separated intersection with at least one of the adjacent second signal lines; and respective second end portions of the first and second signal lines are electrically connected to corresponding terminal portions of the plurality of address electrodes.

According to a twenty-fourth aspect of the present invention, in the surface discharge type plasma display panel of the first aspect, a single pixel is composed of at least four unit luminescent areas; and of the plurality of address electrodes in the single pixel, a terminal portion of an address electrode of an unit luminescent area corresponding to any one emitted color out of the plurality of emitted colors is provided on one end portion of the second substrate and terminal portions of address electrodes of unit luminescent areas corresponding to the other emitted colors are provided on the other end portion of the second substrate, the one end portion and the other end portions of the second substrate being in an inverse relationship with respect to the second direction.

According to a twenty-fifth aspect of the present invention, in the surface discharge type plasma display panel of the fourth aspect, any two of the four unit luminescent areas which are sequentially arranged in the first direction correspond to the blue emitted color.

According to a twenty-sixth aspect of the present invention, in the surface discharge type plasma display panel of the twenty-fifth aspect, the four unit luminescent areas are composed of a first group including two unit luminescent areas of the blue emitted color and of the red emitted color; and a second group including two unit luminescent areas of the blue emitted color and of the green emitted color. The first and second groups form a display area for a single pixel, respectively.

The present invention with the aforementioned structure have the following effect:

The first through eighteenth and twentieth aspects of the present invention allow a plasma display device which is capable of displaying images without varying the sustain period and degrading the levels of other color gradations and further excellent in long-term color reproduction without deterioration of phosphors.

The third aspect of the present invention allows a full color image display.

The fourth aspect of the present invention allows a white color display with a high color temperature.

The fifth aspect of the present invention increases luminance of an emitted color with low spectral sensitivity.

The sixth aspect of the present invention increases luminance of any one emitted color even with the same driving conditions for each emitted color.

The seventh and eighth aspects of the present invention prevent occurrence of unnatural color lines.

The ninth aspect of the present invention allows a white color display with a high color temperature.

The eleventh and twelfth aspects of the present invention allow an excellent image display with a high color temperature with no damage to ornament and no influence on displays of the other emitted colors.

The thirteenth aspect of the present invention allows a display device capable of providing a white color display with a high color temperature while emitting lights excepting a light emitted by a discharge gas component (especially Ne) from the blue unit luminescent area, and improving color purity of blue.

The fourteenth aspect of the present invention makes it possible to desirably balance respective luminescence intensity of the emitted colors when the display surface is viewed directly from the front and improves display characteristics by suppressing the loss of viewing angles when the display surface is viewed from a tilt angle.

The fifteenth aspect of the present invention improves either of insufficient writing or self erasing during address discharge, or unnecessary discharge during address discharge, depending on various conditions of each panel.

The sixteenth aspect of the present invention avoids insufficient writing due to a decrease in address pulse voltage and self erasing due to an increase in address pulse voltage, thereby bringing about an advantage of achieving a stable display image with no flicker.

The seventeenth aspect of the present invention prevents occurrence of unnecessary discharge during address discharge through the achievement of a guard function against an electric field due to a wide address electrode.

The twenty-first aspect of the present invention facilitates the fabrication of address electrodes and prevents a break in the address electrodes and variations in the width of the address electrodes.

The twenty-second aspect of the present invention prevents electrodes on the substrate outside the panel, which are to be connected to the terminal portions of the corresponding address electrodes, from being arranged at irregular pitches.

The twenty-third and twenty-fourth aspects of the present invention avoid the necessity of forming a grade-separated intersection of the terminal portions of the address electrodes on the side of the second substrate.

The twenty-fifth aspect of the present invention readily achieves a white color display with a desired color temperature with two blue unit luminescent areas provided within the four unit luminescent areas.

The twenty-sixth aspect of the present invention has the effect of achieving a high-resolution image display with an increase in effective resolution while achieving a white color display with a desired color temperature.

Thus, an objective of the present invention is to provide a plasma display panel and a plasma display device that can provide a white color display with a high color temperature, e.g., 9300 K, without increasing deterioration of phosphors and sacrificing red and green gradations.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
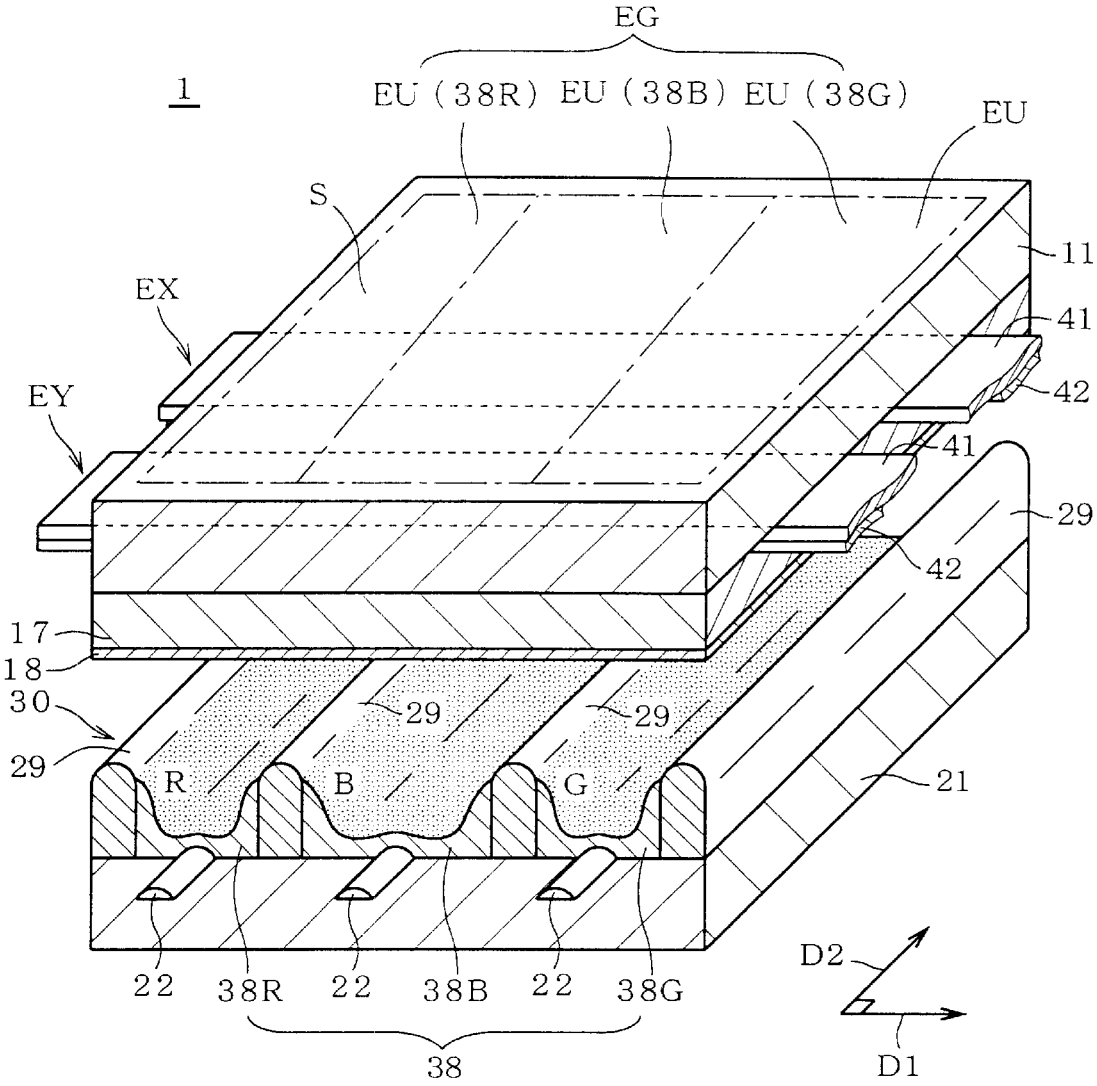
FIG. 1 is a perspective view showing a main sectional structure of a plasma display panel according to a first preferred embodiment.

We will now give a detailed description of an AC surface discharge type plasma display panel and an AC type plasma display device using the panel, with reference to the drawings of each preferred embodiment. In the drawings, the same or corresponding parts to those previously described with reference to FIGS. 29 through 32 are denoted by the same reference numerals or characters.

1. First Preferred Embodiment

FIG. 1 is a perspective view showing a main sectional structure of a surface discharge type plasma display panel (hereinafter referred to as "PDP") according to a first preferred embodiment of the present invention, the panel disassembled for convenience of description. In FIG. 1, the reference numeral 11 designates a front or first substrate formed for example of a transparent glass; 17 is a dielectric layer; 18 is a protective layer formed for example of MgO; 21 is a rear or second substrate; and 22 is a writing or A electrode (address electrode).

The reference character 38R designates a phosphor emitting a red (R) light; 38B is a phosphor emitting a blue (B) light; and 38G is a phosphor emitting a green (G) light, which are generically called "phosphor 38." As will be described later, the first preferred embodiment is characterized in that the blue phosphor 38B has a greater width in the first direction D1 than the red and green phosphors 38R and 38G. Here, the red phosphor 38R is formed, for example, of (Y, Gd) $BO_3$:$Eu^{3+}$; the green phosphor 38G of $Zn_2SiO_4$:Mn; the blue phosphor 38B of $BaMgAl_{14}O_{23}$:$Eu^{2+}$ or of $BaMgAl_{10}O_{17}$:$Eu^{2+}$.

The width of each A electrode 22 in the first direction D1 is about the same irrespective of the widths of the phosphors 38 of each color in the first direction D1. This brings the advantages of less break in wire or less variations in thickness of the A electrode 22 in the formation of the A electrodes 22 since the A electrodes 22 can be formed under the same conditions, e.g., under the same printing condition when they are formed by screen printing.

The reference numeral 29 designates a barrier rib; 30 is a discharge space; 41 is a transparent electrode; 42 is a metal electrode (bus electrode); and the reference character EG designates a pixel. A single pixel EG is composed of unit luminescent areas EU(38R), EU(38B), and EU(38G) corresponding to red (R), blue (B), and green (G), respectively, which are generically called "unit luminescent area EU".

The reference character S designates a display surface; and EX and EY are X and Y electrodes, respectively, which are disposed on the inner surface of the first substrate 11 in parallel with each other at given intervals to induce display discharge therebetween and extending in the first direction D1. Each of the X and Y electrodes EX and EY is composed of the transparent electrode 41 and the metal electrode 42.

Now, we will describe a panel structure of the PDP 1 and a state of discharge. Since the structure for driving the PDP 1 is similar to that in the conventional techniques, we refer to FIG. 29 to describe its operation.

The plasma display device 100 comprises the PDP 1 and the driving control system 2 for driving the PDP 1, which is electrically connected to the PDP 1 via the flexible printed circuit board (hereinafter referred to as "FPC board").

In the driving control system 2, an analog input signal is converted into a digital form by the A/D 120; the digital output from the A/D 120 is stored in the frame memory 130 as a digital image signal; and according to the digital image signal, the output of the scan control unit 110 is supplied to the X-electrode driving circuit 141, the Y-electrode driving circuit 142, and the A-electrode driving circuit 143 to drive the PDP 1.

Driving waveforms for the plasma display device (hereinafter referred also to as "PDP device") with the PDP 1 of the first preferred embodiment may of course be the driving waveforms in the conventional techniques shown in FIGS. 30A through 30E, but various driving waveforms are applicable.

The PDP 1 is a surface discharge type PDP with a three electrode structure having a pair of display electrodes (X electrode EX and Y electrode EY) and the A electrode 22 which correspond to the unit luminescent area EU. Each of the X and Y electrodes EX and EY is composed of the transparent electrode 41 and the metal electrode 42 and disposed on the inner surface of the first substrate 11 on the side of the display surface S.

On the dielectric layer 17 covering the X electrode EX and the Y electrode EY in a display area, the protective layer 18 is provided to prevent deterioration of the dielectric layer 17 due to discharge-induced ion bombardment and to stabilize discharge by smoothing electron emissions during discharge.

Figure 2:
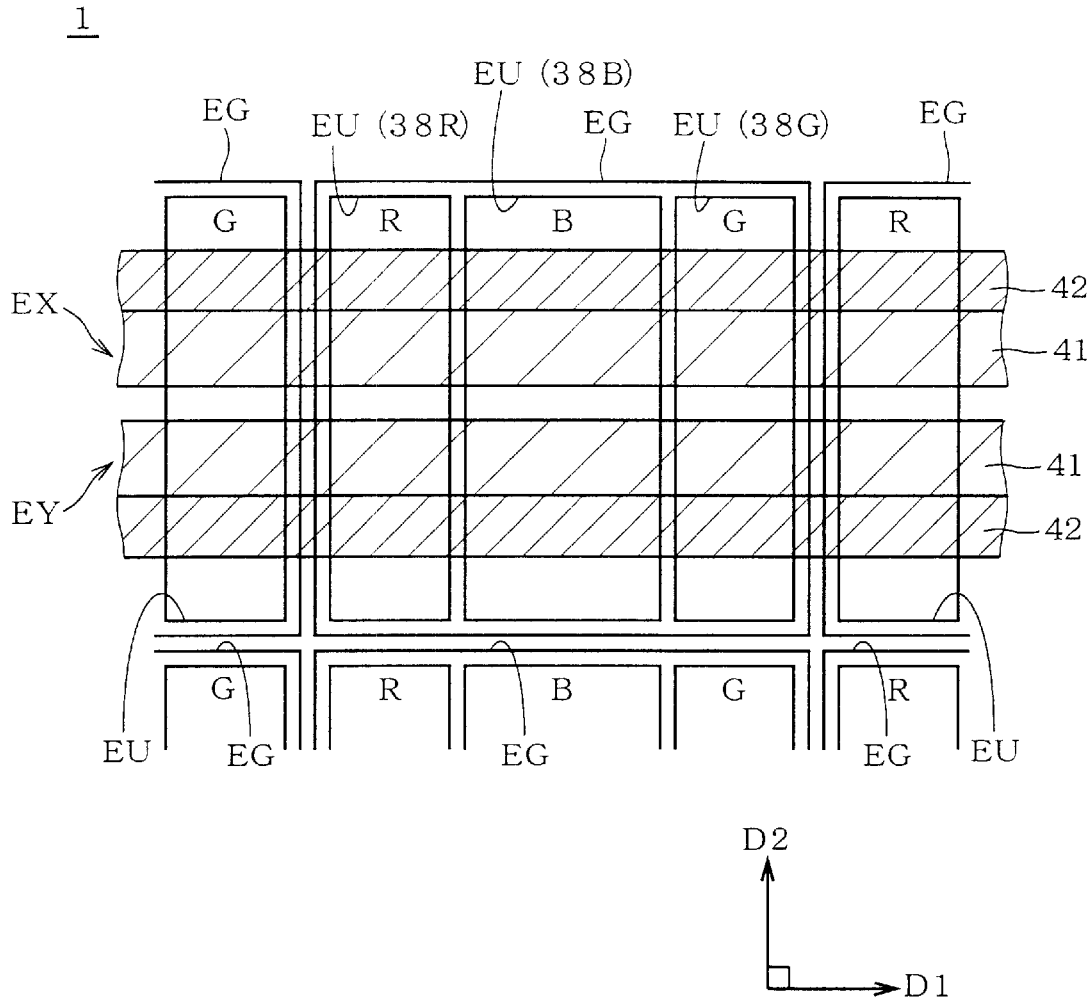
FIG. 2 is an illustration of a pixel and unit luminescent areas viewed from the display surface according to the first preferred embodiment.

On the second substrate 21, the barrier ribs 29 are formed extending in a second direction D2 orthogonal to the first direction D1, with their top portions abutting on the protective layer 18. The discharge space 30 is defined by the facing inner side walls of the respective barrier ribs 29, the inner surface of the first substrate 11, and the inner surface of the second substrate 11. As is seen from the arrangement of the pixel EG (almost in the shape of a square) and the unit luminescent areas EU viewed from the display surface S in FIG. 2, the discharge space 30 is sectioned by each unit luminescent area EU (almost in the shape of a rectangle), and a set of unit luminescent areas EU(38R), EU(38B), and EU(38G) corresponding to three colors: red (R), blue (B) and green (G), respectively, forms a nearly square pixel EG. Further, the blue unit luminescent area EU(38B) has a greater width in the first direction D1 than the red and the green unit luminescent areas EU(38R) and EU(38G).

In FIG. 1, between the parallel barrier ribs 29 in the first direction D1, an A electrode 22 of a given width is disposed by printing and firing a pattern of a silver paste. Then, a generally U-shaped phosphor 38 is provided to fully cover the facing inner side walls of the respective barrier ribs 29, the inner surface of the second substrate 21, and the A electrode 22 except the top portions of the barrier ribs 29 and the vicinity thereof.

Now we will give an explanation for why the blue unit luminescent area EU(38B) is wider in the first direction D1 than the red and the green unit luminescent areas EU(38R) and EU(38G).

Figure 3:
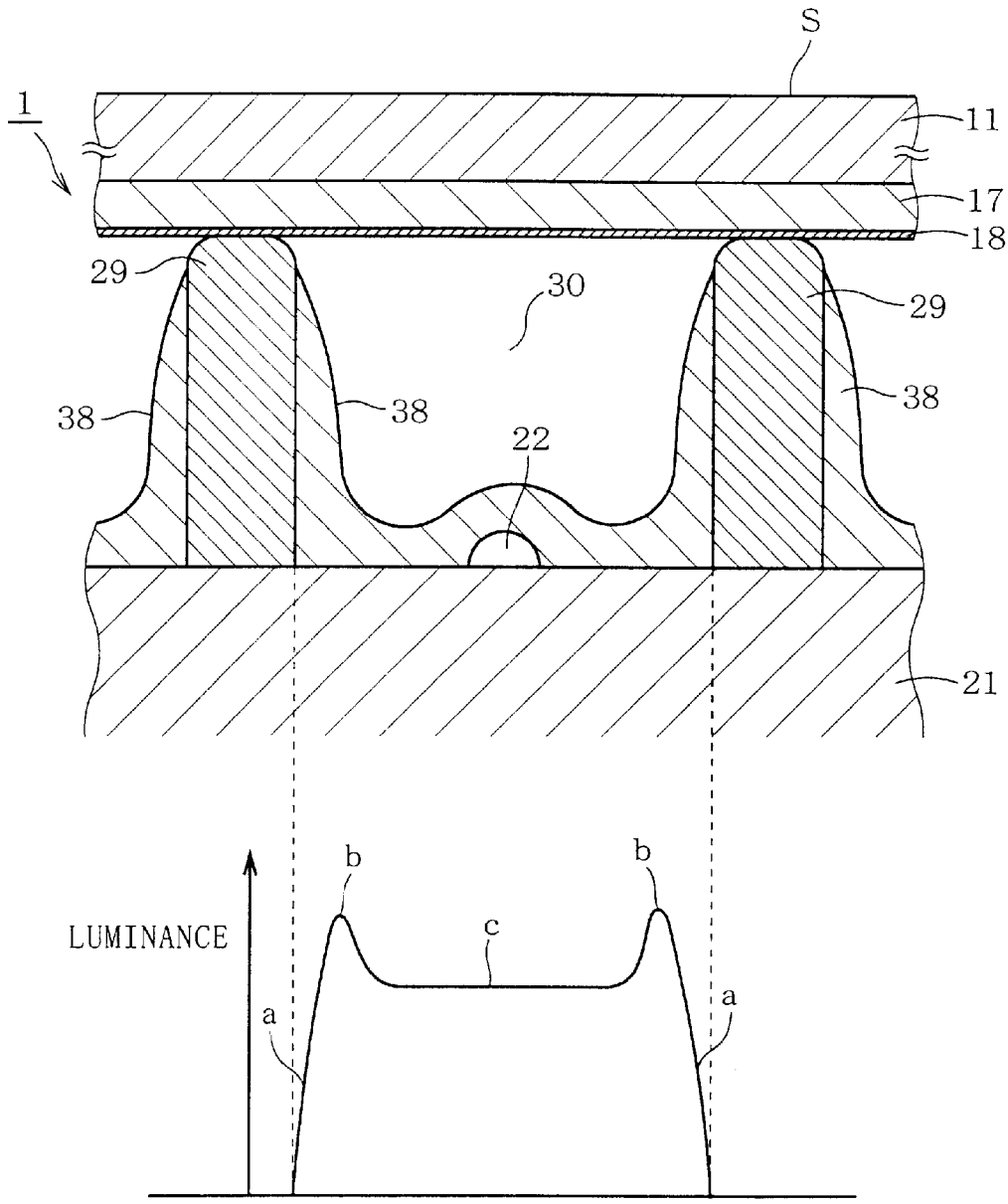
FIG. 3 is schematic view illustrating a phosphor and its luminous components according to the first preferred embodiment.

FIG. 3 schematically shows a correlation between the phosphor 38 and a luminance distribution immediately under the display surface S when viewed from the display surface S. As shown in FIG. 3, the luminance distribution of fluorescence caused by incident ultraviolet rays on the phosphor 38 can be considered from two luminance components: luminous component of fluorescence from the phosphor 38 in the vicinity of the barrier ribs 29; and luminous component of lights emitted from the phosphor 38 on the second substrate 21 including the phosphor 38 on the A electrode 22.

Specifically, luminance in the upper portions of the barrier ribs 29 is low (corresponding to "a" in FIG. 3) since the phosphor 38 on those portions is thin. On the other hand, luminance in the lower portions of the barrier ribs 29 is rather high (corresponding to "b" in FIG. 3) because light emissions occur from both the phosphor 38 on the lower portions of the barrier ribs 29 and the phosphor 38 on the surface (inner surface) of the second substrate 21 in the vicinity of the lower portions of the barrier ribs 29, and each light emission is reflected on the other phosphor 38 (mutual reflection). Luminance above the surface of the second substrate 21 (and the A electrode 22) apart from the barrier ribs 29 is almost constant (corresponding "c" in FIG. 3). As a space between the barrier ribs 29 increases, the luminance above the surface of the second substrate 21 (and the A electrode 22) apart from the barrier ribs 29 (corresponding to "c" in FIG. 3) increases in proportion while the luminance in the vicinity of the barrier ribs 29 (corresponding to "a" and "b" in FIG. 3) remains almost the same. This indicates that luminescence intensity in a direction of the display surface S is approximately proportional to the space between the barrier ribs 29, or the area of the phosphor 38 as will be described later.

Therefore, in order to increase the luminescence intensity of blue beyond the luminescence intensity of red and green, we can increase the area of the blue phosphor 38 on the second substrate 21 and on the A electrode 22.

Since the pixel EG is nearly in the shape of a square and composed of the three rectangular unit luminescent areas, the size of the unit luminescent area EU(38B) varies on a proportional basis with the width of the blue phosphor 38B in the first direction D1 (equivalent to the width of the blue unit luminescent area EU(38B) in the first direction D1). Accordingly, it can be said that the luminescence intensity toward the display surface S varies in proportion to the variations in the width of the blue phosphor 38B.

FIGS. 4A through 4D are schematic views taken along a plane perpendicular to the second direction D2, showing examples of sectional shapes of the second substrate 21 and the barrier ribs 29 formed on the inner surface of the second substrate 21.

Figure 4A:
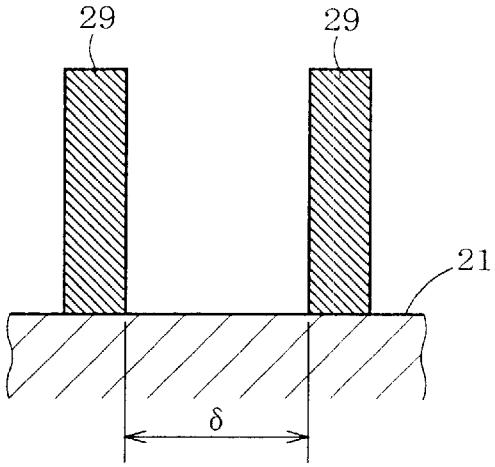
FIGS. 4A through 4D are cross-sectional views taken along a plane of barrier ribs perpendicular to a second direction according to the first preferred embodiment.

FIG. 4A shows barrier ribs 29 having a rectangular sectional shape.

Figure 4B:
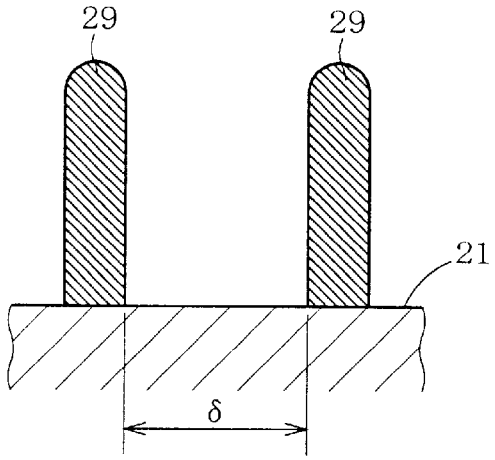

FIG. 4B shows barrier ribs 29 having an inverted U-shaped sectional shape.

Figure 4C:
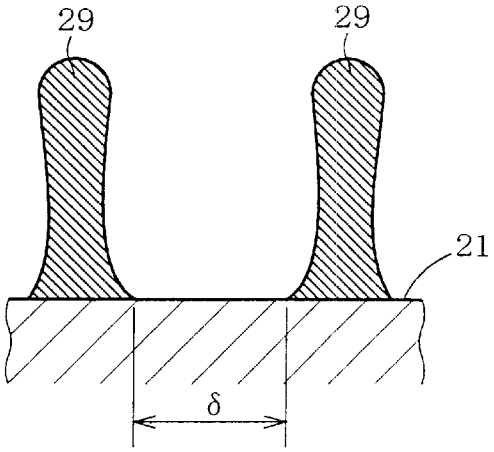

FIG. 4C shows barrier ribs 29 having a Ω-shaped sectional shape.

Figure 4D:
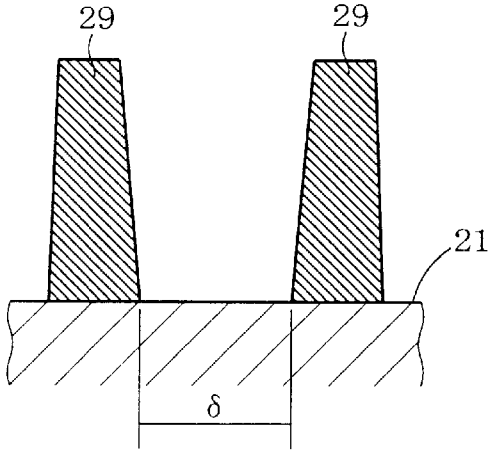

FIG. 4D shows barrier ribs 29 having a trapezoidal sectional shape.

As shown in FIGS. 4A through 4D, the maximum space (gap) between the bottom portions of the adjacent barrier ribs 29 is basically regarded as the width δ of the phosphor 38. In the following description, we will note the widths of phosphors 38 in a nearly square pixel EG.

Figure 5A:
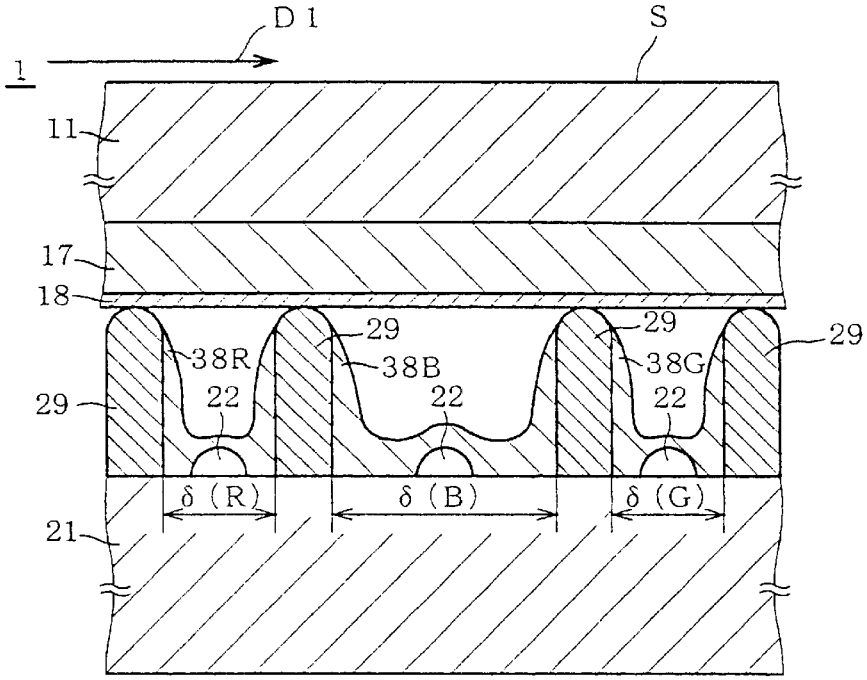
FIG. 5A is a cross-sectional view showing the main structure of the PDP according to the first preferred embodiment.

FIG. 5A is a cross-sectional view of the main structure of the PDP 1 according to the first preferred embodiment.

Figure 5B:
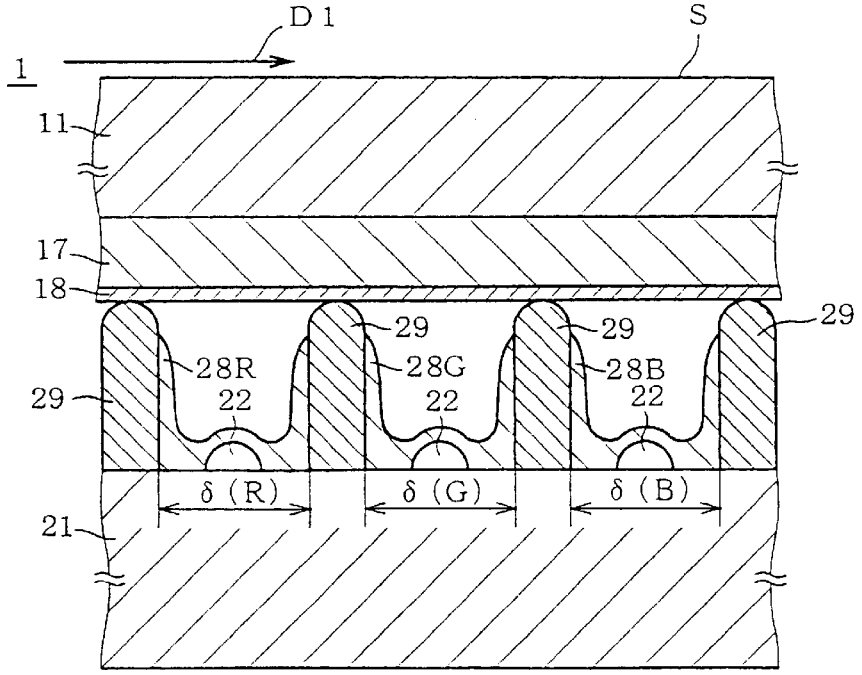
FIG. 5B (PRIOR ART)
FIG. 5B is a cross-sectional view showing the main structure of a conventional PDP.

FIG. 5B is a cross-sectional view of the main structure of a conventional PDP for comparison with FIG. 5A.

As shown in FIGS. 5A and 5B, PDPs used for color-image display comprises the red phosphor 38R or 28R, the green phosphor 38G or 28G, and the blue phosphor 38B or 28B so that the phosphors 38 or 28 can emit lights of three primary colors. In the following description, the widths of the red phosphor 38R or 28R, the green phosphor 38G or 28G, and the blue phosphor 38B or 28B, in the first direction D1, are referred to as "δ(R)", "δ(G)", and "δ(B)", respectively. Further, when the color of a phosphor is Z, the width of that phosphor is referred to as "δ(Z)".

Figure 6:
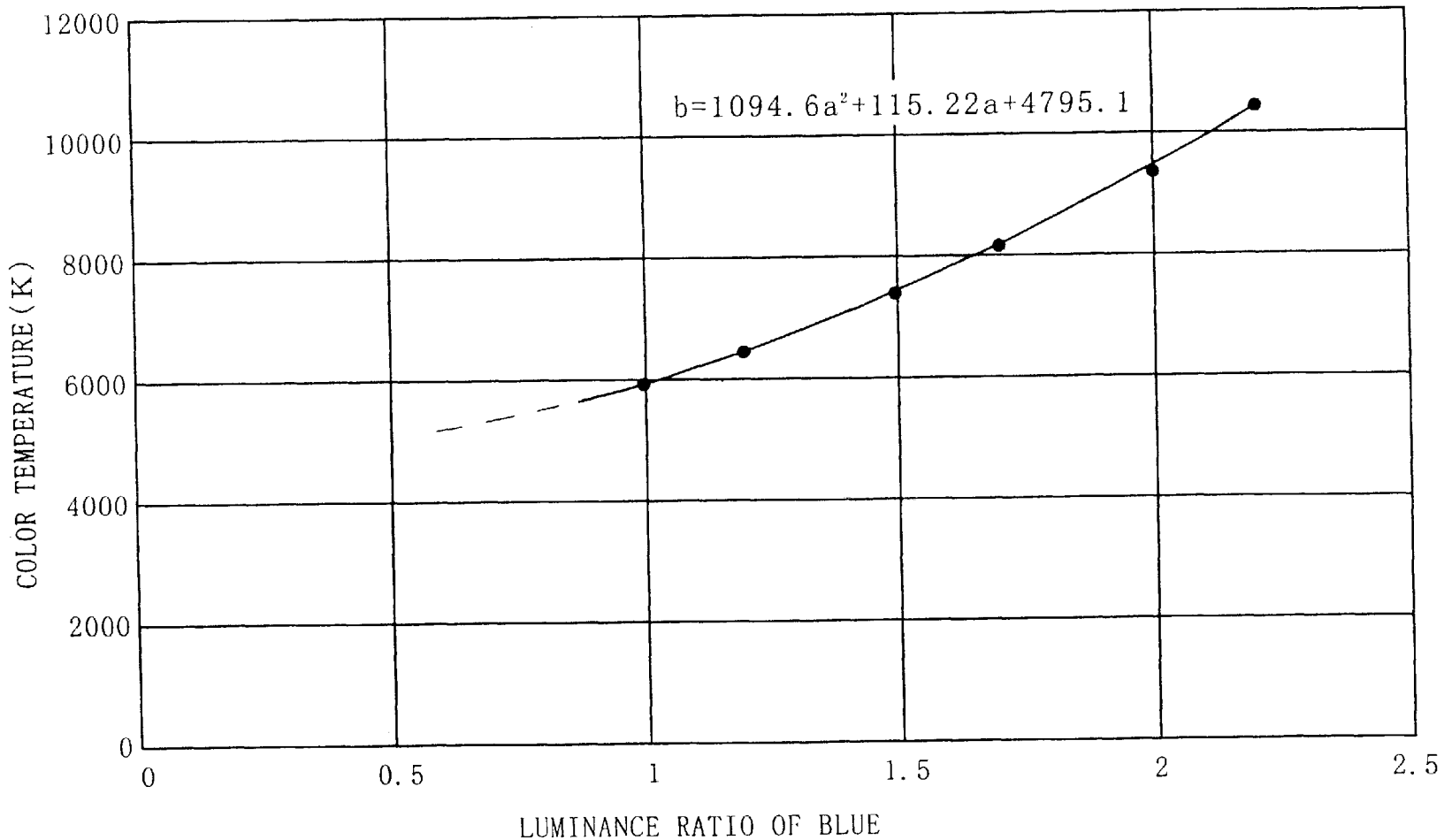
FIG. 6 is a graph showing variations in color temperature with variations in blue luminance where red and green luminance is fixed according to the first preferred embodiment.

We previously described that the intensity of lights emitted from each unit luminescent area EU toward the display surface S is approximately proportional to the distance between the inner side surfaces of the barrier ribs 29. In the conventional PDP shown in FIG. 5B, the widths of the red (R), green (G), and blue (B) phosphors: δ(R):δ(G):δ(B) are in the ratio of 1:1:1, and the luminance of those phosphors when light emission (excitation) from each primary color unit luminescent area EU occurs simultaneously under the same conditions is in the ratio of about 0.51:1:0.22. Here variations in color temperature with variations in the luminance of blue (B) are shown in Table 1 and FIG. 6 where the luminance of red (R) and green (G) is constant.

TABLE 1

Correlation between Luminance Ratio of Phosphors and Color Temperature

| | Conventional PDP | Blue × 1.2 | Blue × 1.5 | Blue × 1.7 | Blue × 2 | Blue × 2.2 |
|---|---|---|---|---|---|---|
| Red (R) | 0.51 | 0.51 | 0.51 | 0.51 | 0.51 | 0.51 |
| Green (G) | 1 | 1 | 1 | 1 | 1 | 1 |
| Blue (B) | 0.22 | 0.26 | 0.33 | 0.38 | 0.44 | 0.49 |
| δ Ratio | 1:1:1 | 1:1:1.2 | 1:1:1.5 | 1:1:1.7 | 1:1:2 | 1:1:2.2 |
| Color Temperature | 6000 | 6500 | 7450 | #200 | 9300 | 10400 |

Note: Red (R) and Blue (B) are luminance ratios when luminance of green (G) is 1;
δ Ratio = 6(R):δ(G):δ(B);
*A unit of color temperature is K (Kelvin).

Here, the color temperature b with respect to the luminous ratio a of blue (B) is approximated to a quadratic curve:

$$b(K)=1094.6a^2+115.22a+4795.1$$

In the estimation of the inventors, when a=2, the color temperature b is approximately 9300 K (slightly bluish white).

Since the luminescence intensity in each unit luminescent area EU is proportional to the size of that unit luminescent area EU and further the area ratio is proportional to the widths thereof in the first direction D1, variations of the color temperature form 6000 to 9300 K can be produced by increasing the width δ(B) of the blue (B) phosphor to about two times the width of the red (R) and green (G) phosphors.

From the viewpoint of improvement in luminance, it is better that the barrier ribs 29 have a shorter width in the first direction D1. In such an ideal case, i.e., when the width of the barrier ribs 29 is so small that it may be ignored in view of the width of a single pixel EG in the first direction D1, a substantial distance between the adjacent barrier ribs 29 which define the blue unit luminescent area EU(38B) is, at a color temperature of 9300 K, about a half the width of the single pixel EG.

In this fashion, a white light with a generally preferred color temperature of about 9300 K can be obtained without sacrificing red and green gradations and increasing deterioration of the phosphors.

In the above example, the ratio of widths δ(R):δ(G):δ(B) stands at 1:1:2 to obtain the luminance ratio of the red (R), green (G), and blue (B) phosphors of about 0.51:1:0.44 in which the color temperature of 9300 K is achieved. Alternatively, the ratio of the widths δ corresponding to the respective emitted colors may be set in consideration of the characteristics of phosphor materials and various conditions to obtain a white color with a desired color temperature.

As another alternative, the levels of blue gradations may be reduced in display, for example, at the conventional color temperature of about 6000 K. In that case, the amount of ultraviolet rays irradiating the blue phosphor can be reduced to about a half as compared with the conventional cases. This prolongs the life of especially the blue phosphor, thereby allowing a PDP excellent in long-term color reproduction.

2. Second Preferred Embodiment

In the aforementioned first preferred embodiment, the width of the blue unit luminescent area EU(B) is about twice the width of the red and green unit luminescent areas EU(R) and EU(G). Alternatively, a pixel EG may comprise a plurality of blue unit luminescent areas. Referring to the drawings, we will now give a detailed description of the pixel EG comprising a plurality of blue unit luminescent areas.

Figure 7:
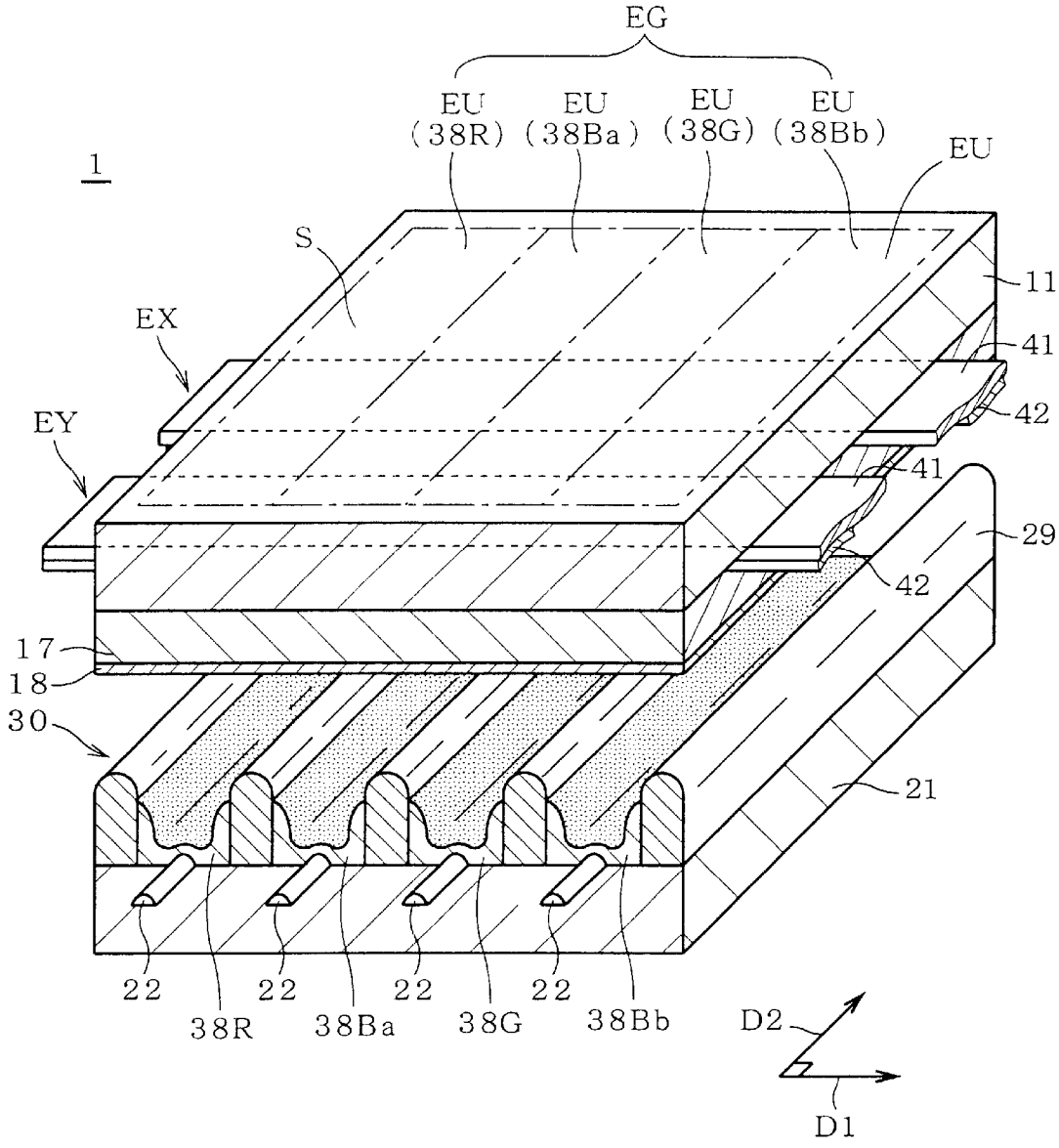
FIG. 7 is a perspective view showing the main structure of a PDP according to a second preferred embodiment.

FIG. 7 is a perspective view of the main structure of a PDP 1 according to a second preferred embodiment. In the drawing, the reference characters 38B*a* and 38B*b* designate two blue phosphors in a single pixel EG, having widths δ(Ba) and δ(Bb), respectively. The phosphors in the single pixel EG are arranged in order of red (R), blue (Ba), green (G), blue (Bb) from left to right along the first direction D1.

The width of the two phosphors 38B*a* and 38B*b* is the same as the widths δ(R) and δ(G), so that the same mask pattern can be used in a deposition process.

Figure 8:
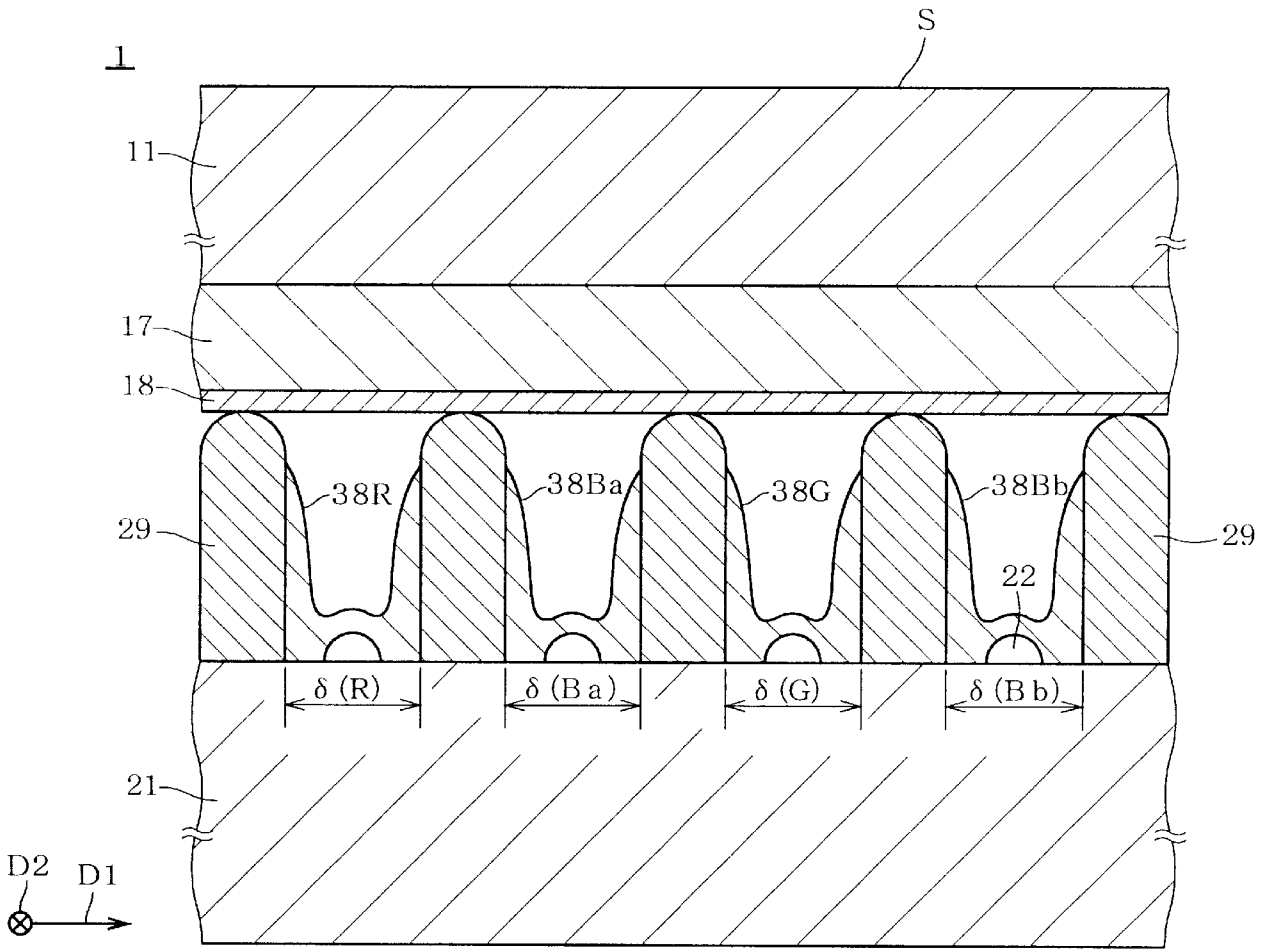
FIG. 8 is an illustration of the width of each unit luminescent area in the pixel according to the second preferred embodiment.

In this case, δ(R):δ(Ba):δ(G):δ(Bb)=1:1:1:1 as shown in FIG. 8. That is, the width of each unit luminescent area EU is about one fourth the width of the pixel EG in the first direction. Further, δ(Ba)+δ(Bb) in the pixel EG may be considered as a substantial width of the blue unit luminescent area EU(B), i.e., δ(Ba)+δ(Bb)=δ(B), and thus δ(R):δ(G):δ(B)=1:1:2. This satisfies the condition to achieve a desired color temperature, described in the first preferred embodiment.

Moreover, such an arrangement of phosphors in order of red(R), blue(Ba), green(G), blue(Bb), brings the following advantages (hereinafter the red, blue, and green phosphors are refereed to as "R", "Ba" and "Bb", and "G", respectively, and the arrangement of phosphors in the single pixel EG is presented, for example, in the form of "R-Ba-G-Bb"). A correlation between the arrangement of phosphors and luminance is schematically shown in FIGS. 9 through 14. In the drawings, a portion surrounded by the broken line indicates the single pixel EG; and a portion surrounded by the solid line indicates the single unit luminescent area EU. A screen of the PDP 1 is composed of a plurality of pixels EG, and the single pixel EG is, in this case, composed of four unit luminescent areas.

Figure 9:
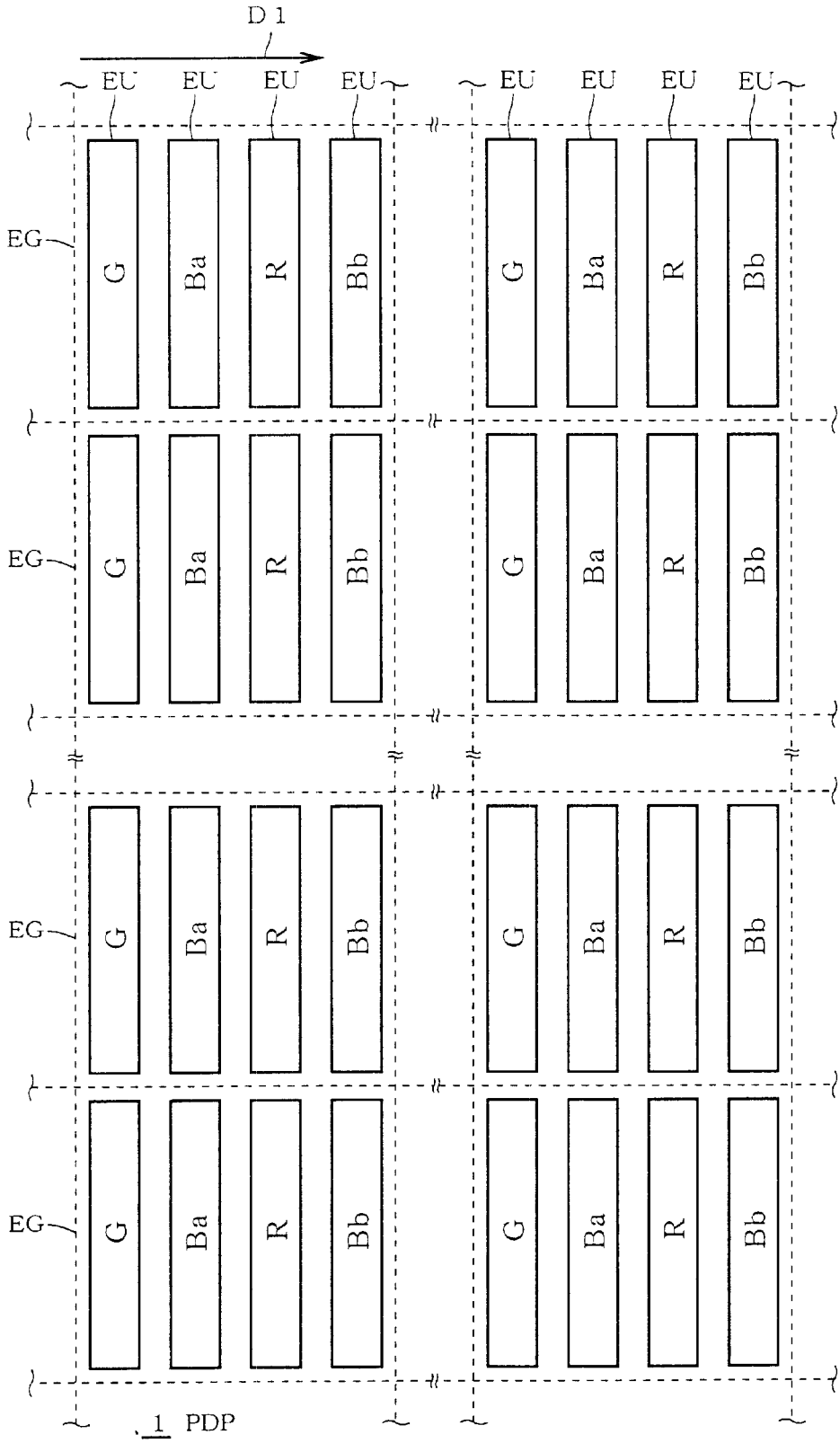
FIGS. 9 through 14 are schematic diagrams showing the arrangements of phosphors according to the second preferred embodiment.
Figure 10:
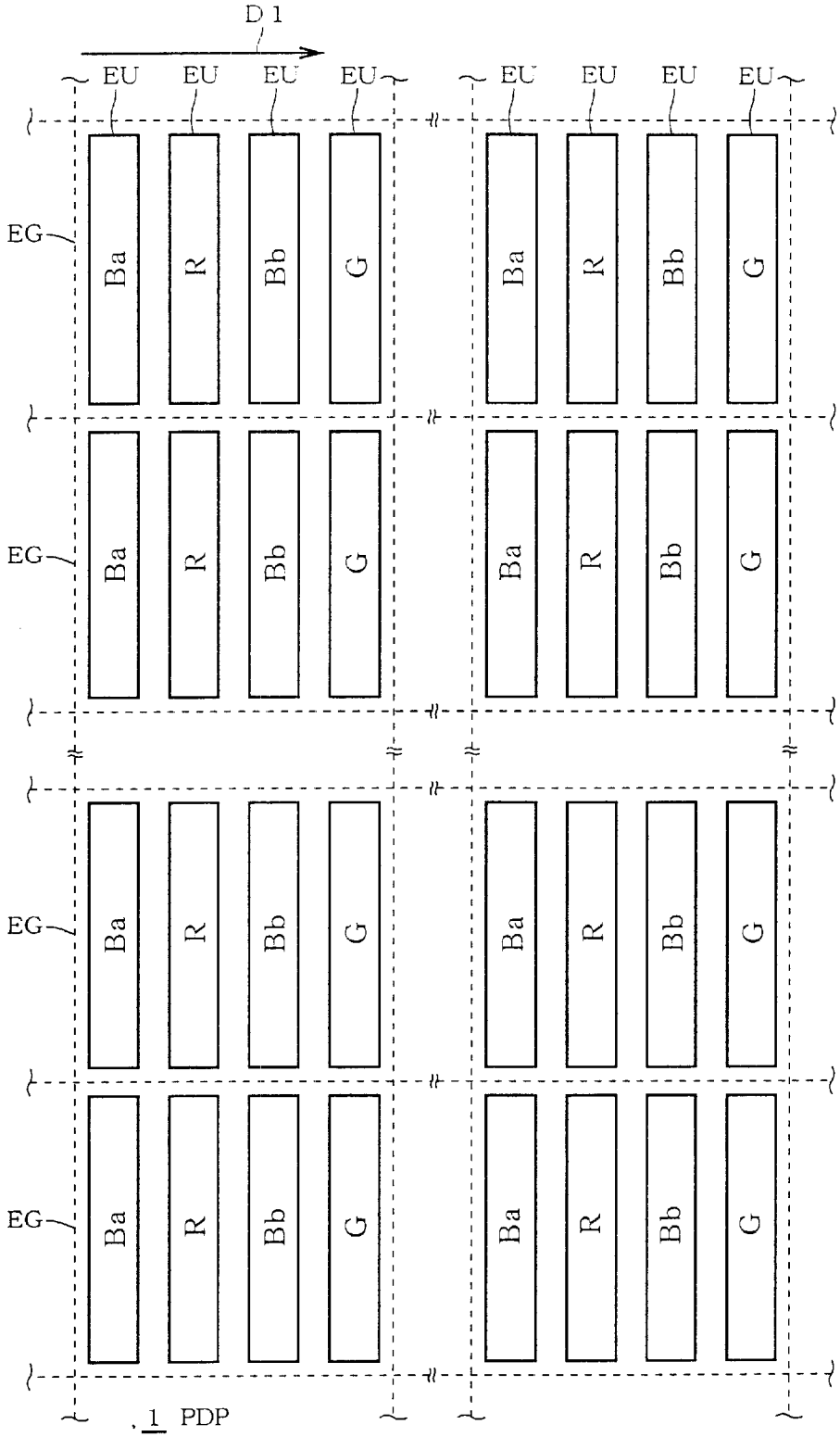
Figure 11:
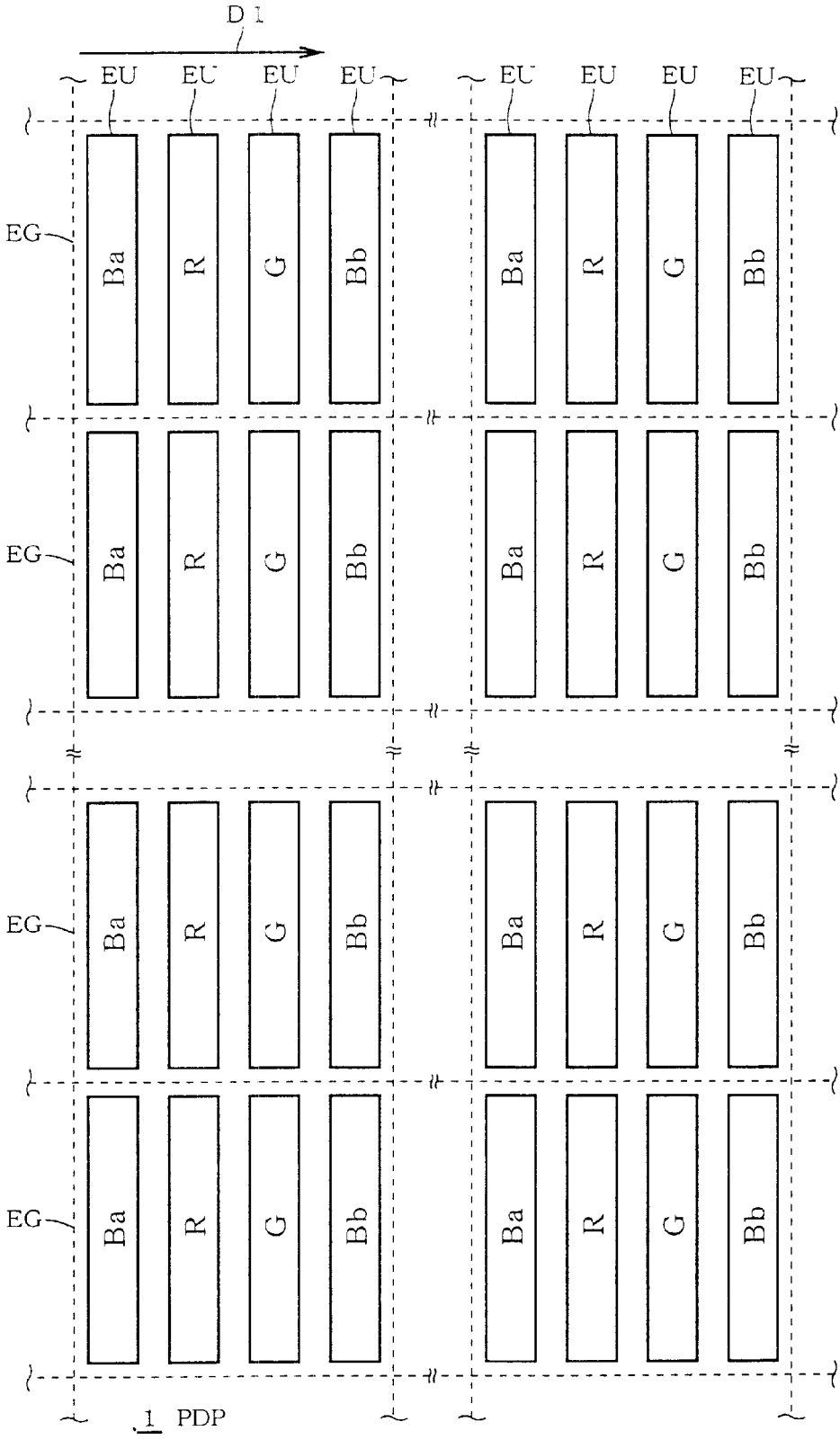
Figure 12:
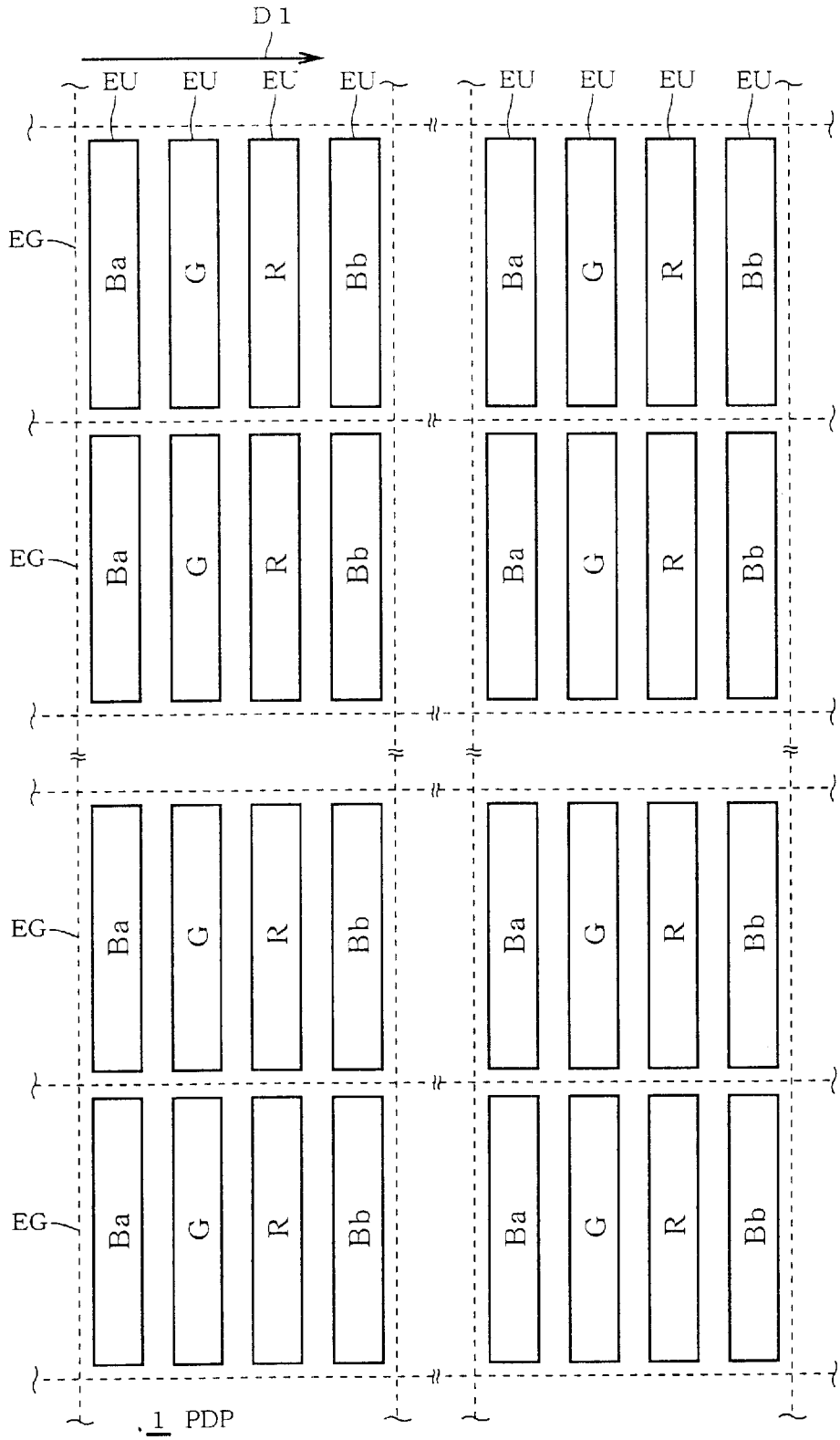
Figure 13:
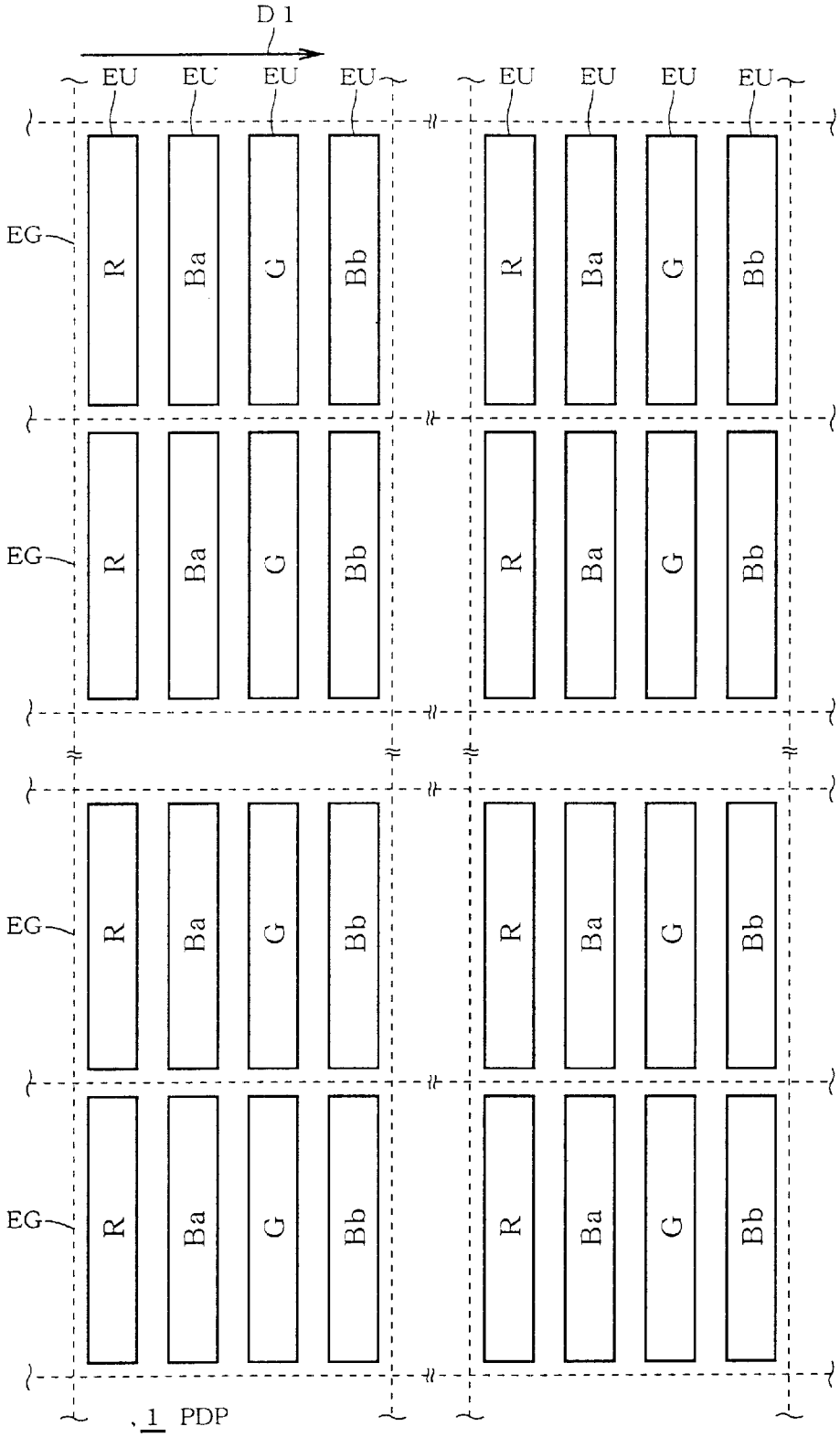
Figure 14:
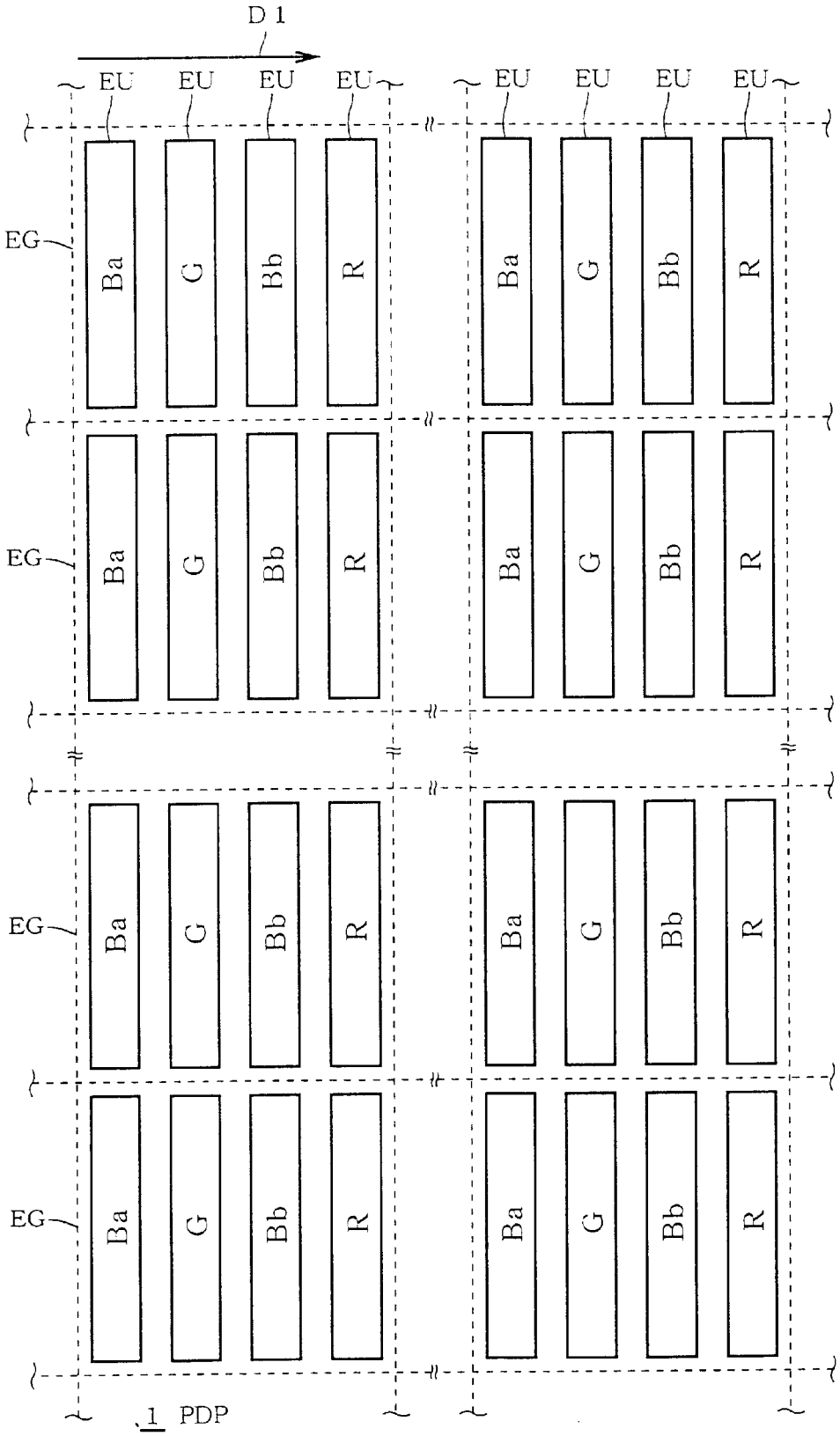

FIGS. 9 through 14 are schematic diagrams each showing the arrangement of phosphors viewed from the display surface S. We will describe the arrangements referring to the drawings (hereinafter enclosed part in parentheses ([ ]) designates the arrangement of unit luminescent areas EU of the respective colors in the single pixel EG). Assuming that the single pixel EG includes colors G, Ba, R, and Bb, probable arrangements of phosphors in the PDP 1 are, for example:

(a) [G-Ba-R-Bb]-[G-Ba-R-Bb]- . . . -[G-Ba-R-Bb] (cf. FIG. 9);

(b) [Ba-R-Bb-G]-[Ba-R-Bb-G]- . . . -[Ba-R-Bb-G] (cf. FIG. 10).

In the arrangements (a) and (b), green (G) is at the end portion of the screen: at the left end portion in FIG. 9 and at the right end portion in FIG. 10. Since green intrinsically has high luminous efficiency to the human eye (with wavelengths of about 550 nm), in a white color display across the entire screen, we may feel the existence of a green line (green color line) at the end portion of the screen.

Alternatively, the following arrangements are also possible:

(c) [Ba-R-G-Bb]-[Ba-R-G-Bb]- . . . -[Ba-R-G-Bb] (cf. FIG. 11);

(d) [Ba-G-R-Bb]-[Ba-G-R-Bb]- . . . -[Ba-G-R-Bb] (cf. FIG. 12);

(e) [R-Ba-G-Bb]-[R-Ba-G-Bb]- . . . -[R-Ba-G-Bb] (cf. FIG. 13);

(f) [Ba-G-Bb-R]-[Ba-G-Bb-R]- . . . -[Ba-G-Bb-R] (cf. FIG. 14).

In the arrangements (c) and (d), green and red with high luminous efficiency are both in the central portion of the pixel EG such as [ . . . -G-R- . . . ] or [ . . . -R-G- . . . ]. Thus, we may feel the existence of a yellowish line (yellow color line) in that portion. In that case, we may also feel the existence of a blue line (blue color line) because blue is arranged over two adjacent pixels EG such as [ . . . -Bb]-[Ba- . . . ].

In the arrangements (e) and (f), on the other hand, green with high luminous efficiency is not arranged at the end portion of the screen; green and red is not arranged together in the central portion of the pixel; and the same color is not arranged over two adjacent pixels. Thus, unlike the arrangements (a) to (d), the arrangements (e) and (f) are excellent for image display with no unnatural color line.

In this fashion, blue light emission can be increased with such a simple structure that a single pixel EG comprises a plurality of blue unit luminescent areas EU. Thus, by considering the arrangement of the phosphors, we can achieve a PDP suitable for image display with no unnatural color line and no color interference between pixels EG as well as excellent in color reproduction in image display with no degradation in the levels of red and green gradations.

The above structure allows an image with a high color temperature. Alternatively, in the conventional state of color temperature, either one of the two blue unit luminescent areas EU(Ba) and EU(Bb) may emit a light for a given period of time in turn, or they may alternately emit a light for each frame of an image to prolong the life of blue phosphors. In that case, the amount of ultraviolet rays irradiating the blue phosphors forming the unit luminescent areas EU(Ba) and EU(Bb) can be reduced to about a half as compared with the conventional cases. This prolongs especially the life of blue phosphors, thereby allowing a PDP excellent in long-term color reproduction. Further, while the pixel EG in the above example is approximately divided into quarters, it may be divided into more portions and does not have to be equally divided.

3. Third Preferred Embodiment

In the PDP devices, a filter is often provided forward of the display surface as a part of an enclosure in order to prevent degradation in display contrast due to reflection of extraneous lights such as interior lighting on the panel surface. In the conventional PDP devices, a bluish filter with high transmittance of blue is provided for the prevention of display contrast degradation, which brings about the effect of increasing a color temperature. Such an effect can also be obtained by forming the first substrate on the display surface, of a bluish colored glass.

This technique, however, causes the problem that red and green in displays are not pure because of the influence of the blue filter or the colored glass. Further, the screen of the off-state PDP device looks bluish, which mars the interior of a room in which the PDP device is set.

The PDPs described in the first and second preferred embodiments, on the other hand, allows a filter for preventing display contrast degradation without causing such problems. A third preferred embodiment addresses this point.

Figure 15:
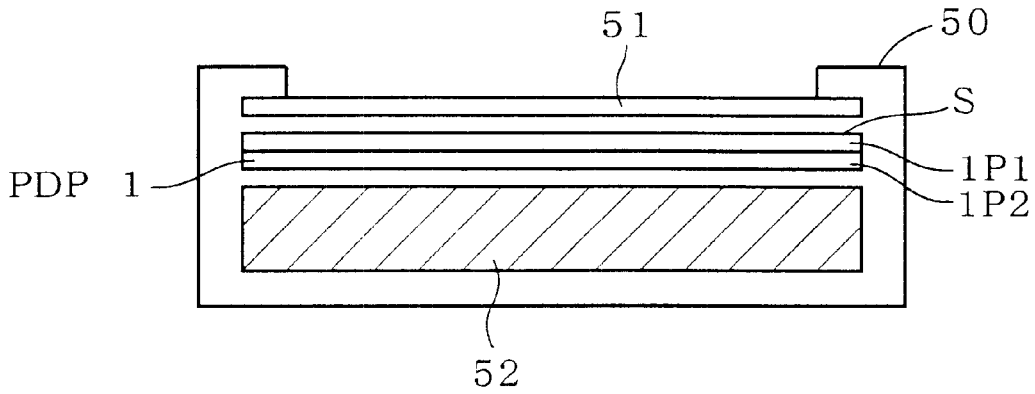
FIG. 15 is a longitudinal cross-sectional view schematically showing an example of a PDP device according to a third preferred embodiment.

The PDPs 1 with the structures of the first and second preferred embodiments have the characteristic of relatively high luminescence intensity of blue as compared with red and green since the substantial blue (unit) luminescent area is larger than the red and green unit luminescent areas. Further, white intrinsically has a high color temperature in the PDP 1. Therefore, instead of the blue filter, a so-called ND (Neutral Density) filter 51 with the transmittance characteristic independent of wavelengths can be used, as shown in FIG. 15, as a filter for preventing display contrast degradation which is to be provided forward of the display surface S. This ND filter 51 is of a neutral gray color, so that even if provided forward of the enclosure 50, it neither mars the interior of a room nor affects red and green display light emissions. Besides, the use of the PDPs 1 of the first and second preferred embodiments allows good image displays with a high color temperature.

Figure 29:
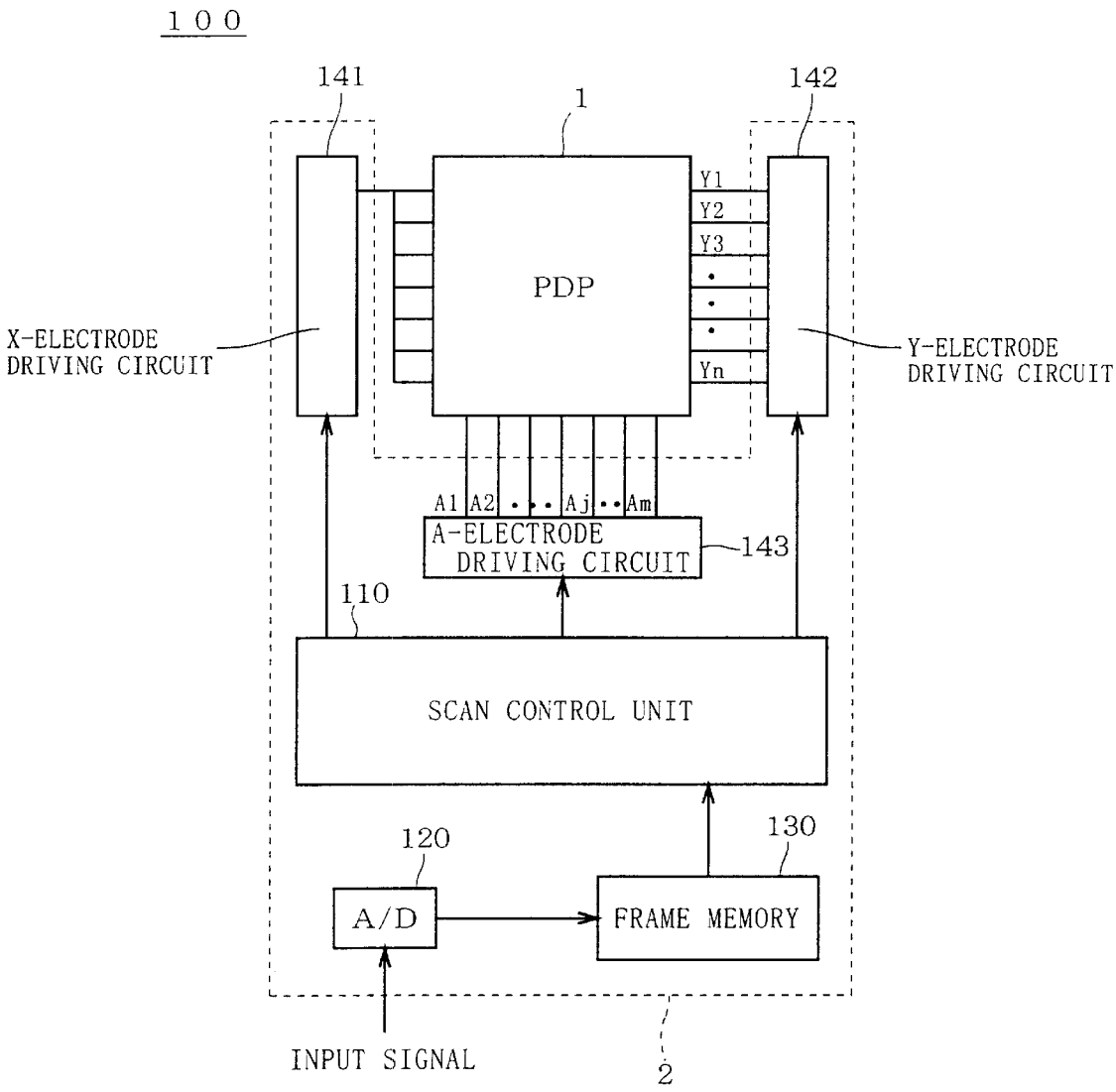
FIG. 29 (PRIOR ART)
FIG. 29 is a block diagram showing a conventional plasma display device.
Figures 30A, 30B, 30C, 30D, 30E:
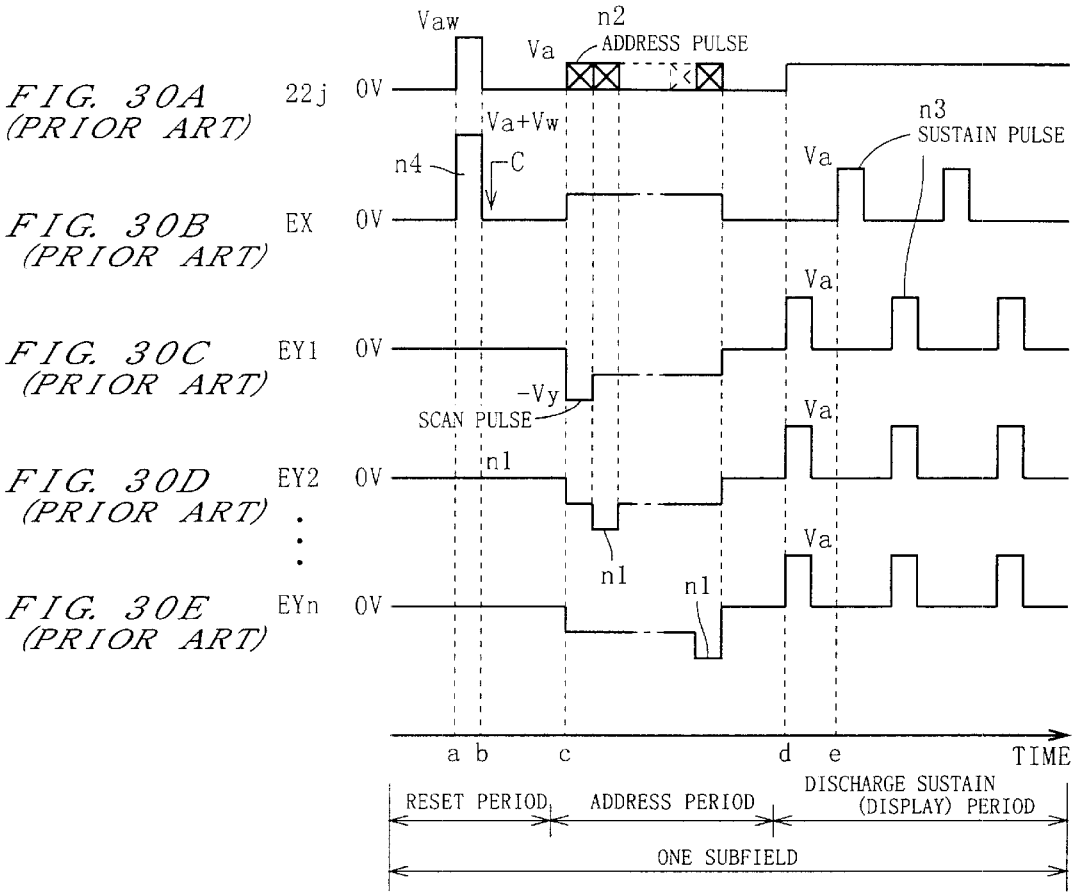
FIG. 30A (PRIOR ART)
FIG. 30B (PRIOR ART)
FIG. 30C (PRIOR ART)
FIG. 30D (PRIOR ART)
FIG. 30E (PRIOR ART)
FIGS. 30A through 30E are timing charts showing waveforms of driving signals in one subfield.
Figure 31:
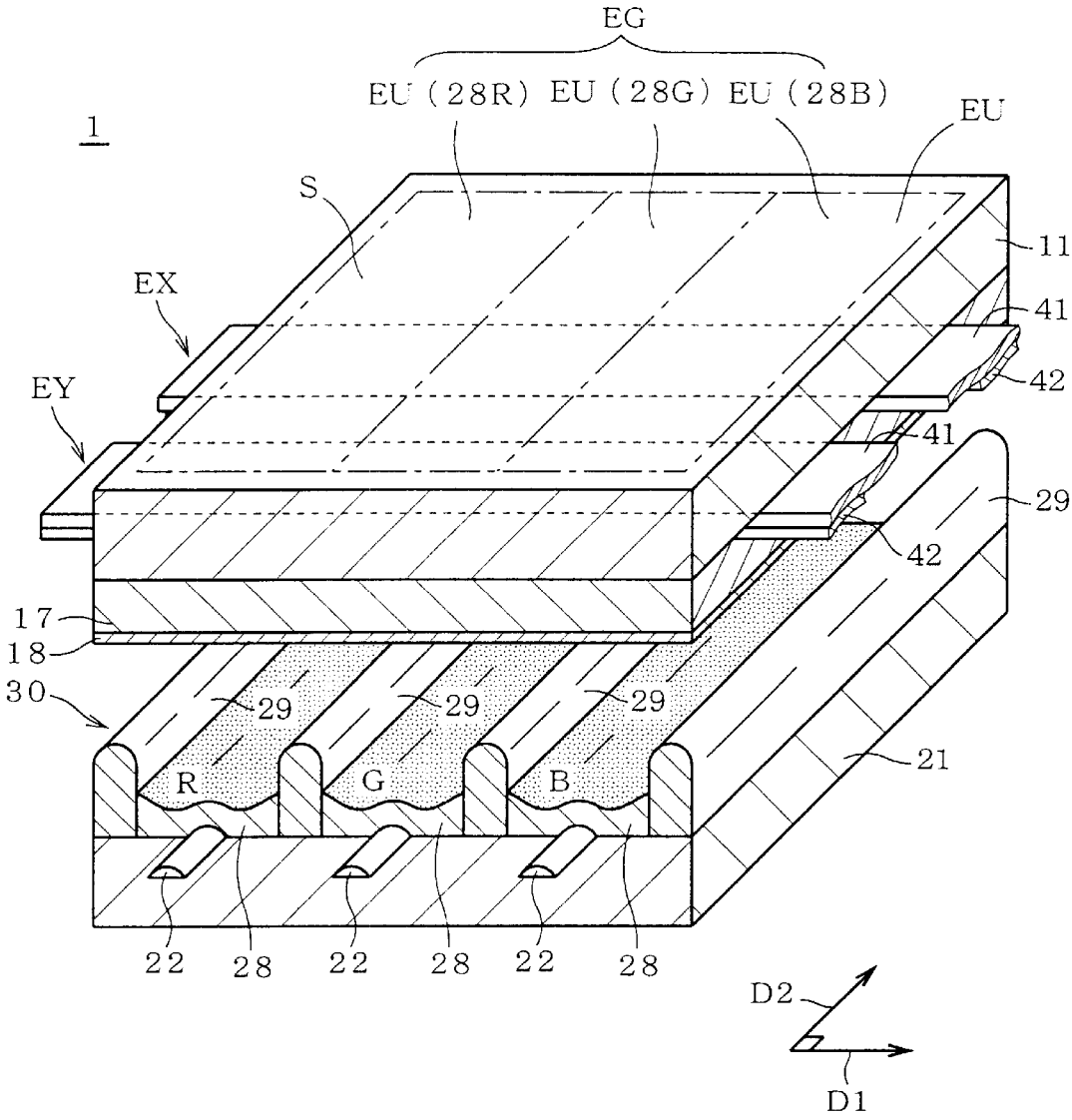
FIG. 31 (PRIOR ART)
FIG. 31 is a perspective view showing the structure of the conventional PDP.
Figure 32:
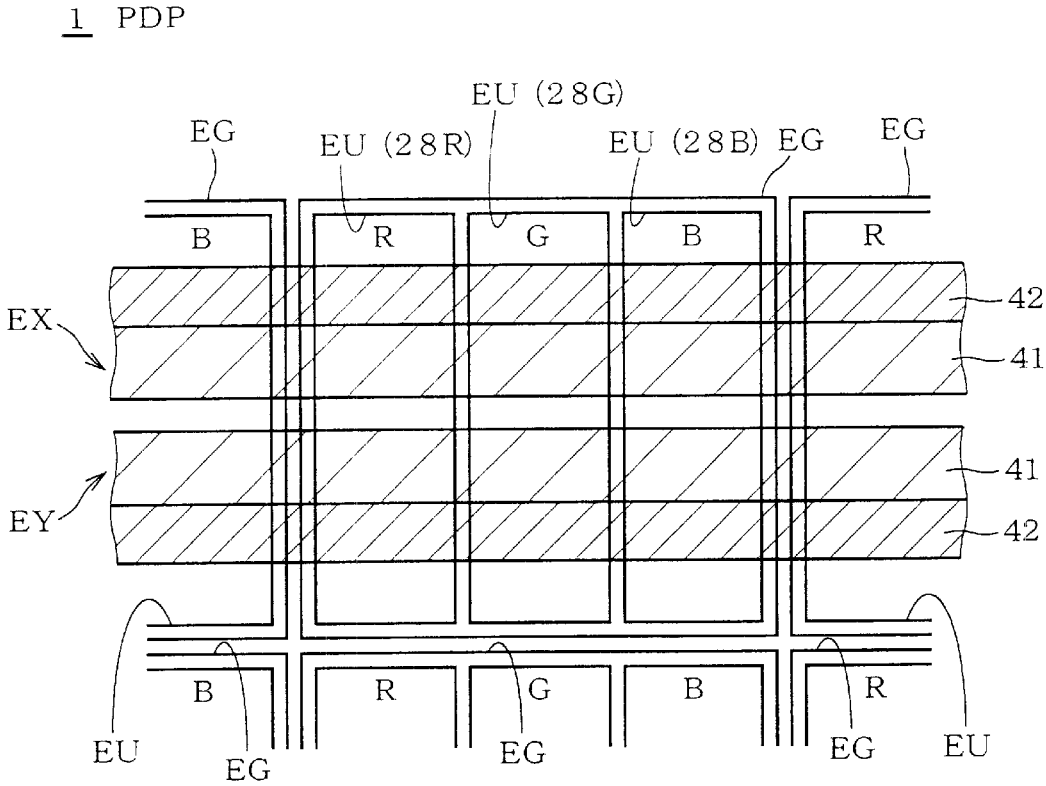
FIG. 32 (PRIOR ART)
FIG. 32 is a schematic view showing the arrangement of phosphors viewed from the display surface S in the conventional PDP.

The reference numeral 52 in FIG. 15 designates a portion to house the driving control system 2 in FIG. 29, which is provided in the enclosure 50 on the side of a rear panel 1P2 bonded with a front panel 1P1.

3-1. Modifications

As a modification of the third preferred embodiment, the first substrate 11 may be colored in gray to be a substitute for the ND filter 51 of FIG. 15. In this case, the same effect can be obtained.

In this fashion, the first characteristic of the third preferred embodiment is that a filter plate (e.g., ND filter 51) having a spectrum that transmittance of each wavelength is almost uniform in the visible luminescent wavelength region, is provided forward of the display surface S of the PDP 1.

The second characteristic is that a substrate having a spectrum that transmittance of each wavelength is almost uniform in the visible luminescent wavelength region (e.g., a glass substrate colored in gray) is used as the first substrate on the display surface side of the PDP 1.

4. Fourth Preferred Embodiment

Focusing on purity of three primary colors in the PDPs, we usually find the following problem. Specifically, discharge gas in the PDPs generally contains a large amount of Ne in order to lower the consumption of electrodes, so that Ne-specific orange light emission is mixed in display lights from the phosphors. This degrades purity of respective emitted colors of discharge cells.

To solve this problem and improve purity of each emitted color, there has been proposed a method for forming internal filters each having a transparent spectrum corresponding to a desired emitted color, in portions of the first substrate corresponding to red (R), green (G) and blue (B) light emitting cells. In this method, however, three kinds of filter materials have to be formed with high alignment accuracy, which results in increased number of processes, deterioration in yield, and high cost.

Another solution is to form the aforementioned blue transparent filter only on the blue luminescent area, focusing only on blue which is most strongly affected by the Ne light emission. This method considerably simplifies the process and cuts down cost. However, even with the blue transparent filter, it is difficult to completely pass blue lights, so that absorption of a considerable degree of blue lights is unavoidable in the step of absorbing the Ne light emission. Further, in the conventional PDP structure, blue light emission is intrinsically weak as compared with red and green light emissions. Thus, even if color purity is improved with the above solution, the color temperature of white color display will further decrease.

The PDPs 1 of the first and second preferred embodiments, on the other hand, drives away the influence of the Ne light emission on the emitted blue color without causing such a problem. A fourth preferred embodiment addresses this point.

The PDP 1 with the structure of FIG. 1 has the characteristic of relatively high luminescence intensity of blue as compared with red and green since the substantial blue (unit) luminescent area is larger than the red and green unit luminescent areas. Thus, as shown in FIGS. 16A and 16B, blue filters 53 are provided in portions of the dielectric layer 17 on the inner surface of the first substrate 11, corresponding to the blue unit luminescent areas.

The PDP with the filters 53 can achieve relatively high luminance of blue while transmittance of the Ne light emission from the blue unit luminescent area is considerably low. That is, while green and red emitted colors whose purity is hardly affected by the Ne light emission, are emitted directly from the panel without passing through a filter for absorbing the Ne light emission, a blue emitted color passes through the filter to remove the Ne light emission before it is emitted from the panel. In this case, the intensity of blue lights emitted from the blue phosphors 38B is considerably high by the use of the PDP 1 of the first preferred embodiment as compared with the use of the conventional PDP. Thus, even with somewhat decay of luminescence by the blue filters 53, the intensity of blue lights radiated from the panel is sufficiently great, whereby the PDP can have high blue color purity and a white color display with a high color temperature. Besides, the filter is used only for blue, which suppresses the increase in cost in the manufacturing process to a minimum.

Figure 16A:
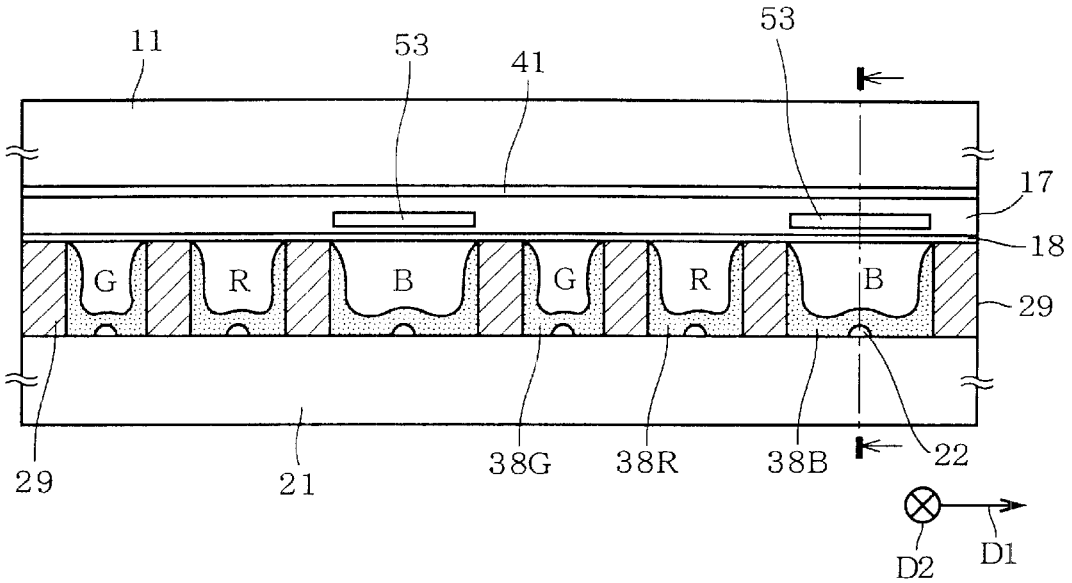
FIGS. 16A and 16B are longitudinal cross-sectional views schematically showing an example of a PDP device according to a fourth preferred embodiment.
Figure 16B:
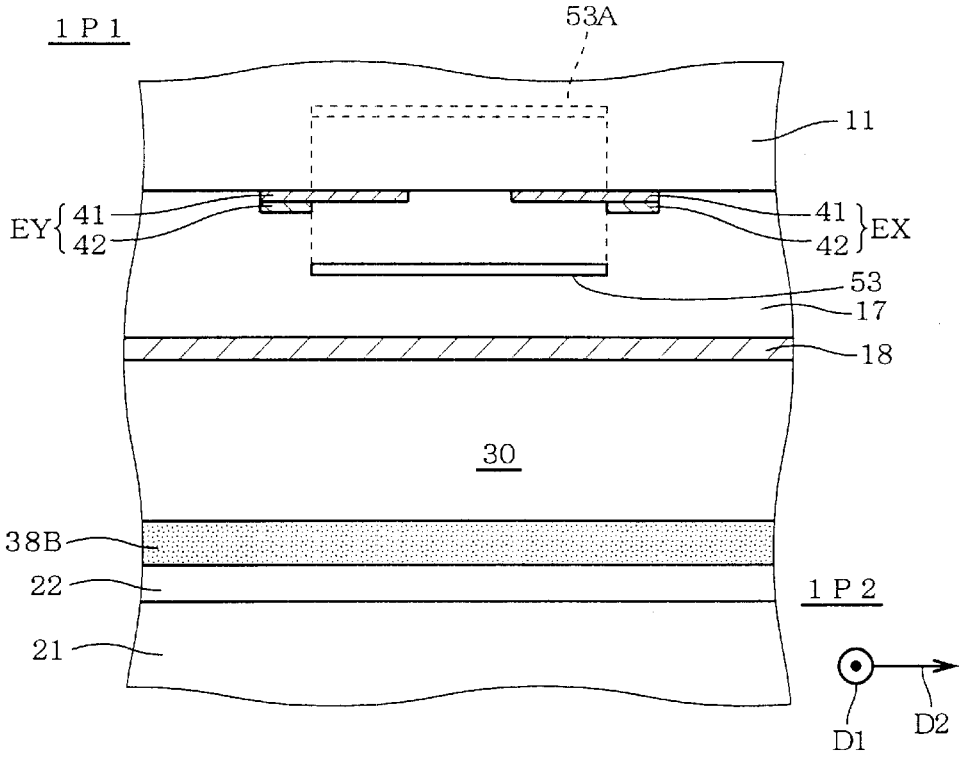

While the blue filters 53 are provided to the PDP 1 in FIG. 1 in FIGS. 16A and 16B, they may of course be provided to the PDP 1 of the second preferred embodiment in FIG. 7.

In this fashion, the PDP of the fourth preferred embodiment is characterized in that the PDP 1 of the first or second preferred embodiment is provided with the filters 53 which have a spectrum that transmittance of the blue light wavelength is high and transmittance of the red light wavelength is low and which are arranged in portions of the dielectric layer 17 formed on the inner surface of the first substrate 11 on the display surface side of the PDP, the portions corresponding to the blue light emitting cells.

It is most preferable that the blue filter 53 which can fully cover a plane area sandwiched between the facing bus electrodes 42 on one display line (i.e., the maximum area through which lights are passed toward the display surface S) be arranged inside the dielectric layer 17 as shown in FIG. 16B. Further, instead of the case of FIG. 16B, the blue filter 53 may be provided only above the inner surface of the first substrate 11 sandwiched between the facing transparent electrodes 41 on one display line, or it may be provided on a surface of both X and Y electrodes EX and EY on the one display line and on the inner surface of the first substrate 11 sandwiched between the X and Y electrodes EX, EY. The location of the blue filter 53 is not limited to the inside of the dielectric layer 17. Alternatively, as shown by the broken line in FIG. 16B, the blue filter 53A may be provided in a portion of the first substrate 11 corresponding to the blue light emitting cells. That is, the blue filter having the aforementioned transparent spectrum should be provided in a portion of the front panel 1P1 corresponding to the blue unit luminescent area.

5. Fifth Preferred Embodiment

A fifth preferred embodiment improves a new problem caused by the adoption of the PDP 1 of the first preferred embodiment.

Figure 17:
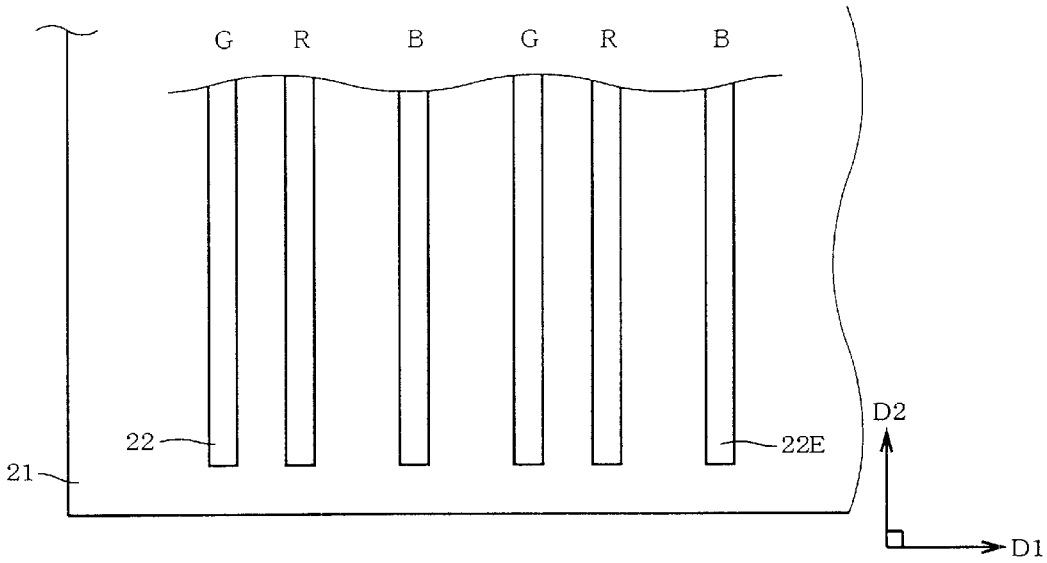
FIG. 17 is a top view that illustrates a problem with the PDP of the first preferred embodiment.

In the PDP 1 with the structure of FIG. 1, pitches between respective adjacent A electrodes 22 are eventually irregular (see FIG. 17). Since one end portions (or terminal portions) of the A electrodes 22 are not covered by the phosphors 38 (or a graze layer 62 which will be described later with reference to FIG. 28), the one end potions have to be electrically connected to the A-electrode driving circuit 143 of FIG. 30 via the FPC board by connecting those portions to electrodes of the FPC board (not shown) at the end portion of the second substrate. It may not be impossible to adjust the arrangement of electrodes on the FPC board with the irregular pitch of the A electrodes 22 thereby to connect the terminal portions of the A electrodes 22 with the FPC board, but this causes a problem as follows. In general, the average pitch of the A electrodes is 0.5 mm or less. Since the pitch of the A electrodes needs to be approximately 0.2 mm in order to use a PDP device as a high-resolution display device such as HDTV (High Definition TV), the average insulation distance in wiring on the FPC board in this case is about 0.1 mm. Further, although a voltage of about 50 to 70 V is applied as a signal to the A electrodes 22, a withstand voltage of generally-used FPC boards is limited to 100 V when the insulation distance is 0.1 mm. Accordingly, the adoption of the PDP 1 in FIG. 1 (i.e., irregular pitch between adjacent A electrodes and further narrowed insulation distance on the FPC board) presents a serious obstacle to reliability against dielectric breakdown.

To resolve this problem, the shape of the terminal portions of the A electrodes 22 is improved in the fifth preferred embodiment so that the A electrodes at the end portion of the second substrate are arranged almost at regular intervals. At this time, to improve practicality, the terminal portions of the A electrodes may be divided into several blocks in accordance with the width of the FPC board to be connected.

Figure 18:
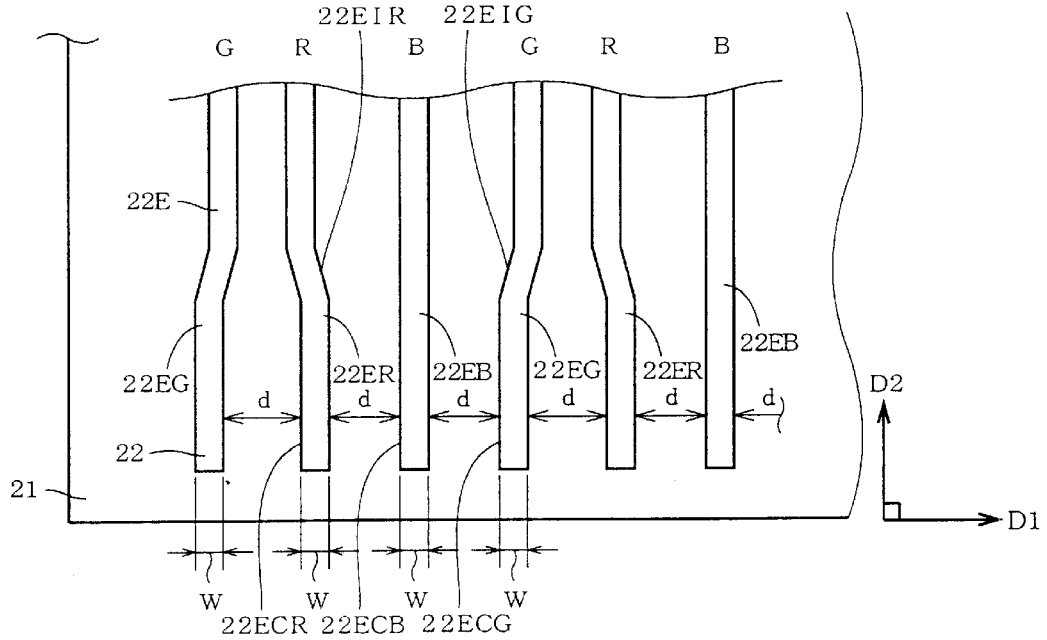
FIG. 18 is a top view showing an example of the shapes of terminal portions of A electrodes in a PDP according to a fifth preferred embodiment.

FIG. 18 shows an example. In FIG. 18, terminal portions 22EB of the A electrodes 22 corresponding to the wide blue unit luminescent areas in the first direction D1 are formed in a straight line; and respective intermediate parts 22EIG, 22EIR of terminal portions 22EG and 22ER of the A electrodes 22 for green and red are bent toward the adjacent terminal portion 22EB of the A electrode 22 for blue in the same pixel. Thus, connected parts (tip portions) 22ECR, 22ECB, 22ECG of the respective terminal portions 22E to be connected to the corresponding electrodes on the FPC board (not shown) and the vicinity thereof are arranged with each other at a regular pitch d in the first direction D1. Here the reference character W designates a width of the terminal portions 22E. In this fashion, the aforementioned problem can be resolved.

6. Sixth Preferred Embodiment

A sixth preferred embodiment improves the second preferred embodiment. We will first describe a new problem caused by the adoption of the PDP 1 of the second preferred embodiment and then propose solutions to the problems.

In the PDP 1 of FIG. 7, for example, color components of the four strip unit luminescent areas EU, forming the single pixel EG, are arranged in order of R, B, G, B. Since the single pixel EG comprises the two unit luminescent areas EU(38B*a*) and EU(38B*b*), we can apply the same signal to the A electrodes 22 of those areas EU(38*a*) and EU(38B*b*) for display of the PDP 1. However, if output terminals of a plurality of address drivers IC which constitute the A-electrode driving circuit (hereinafter referred to as "address driver") 143 are allotted one by one to the respective terminal portions of the A electrodes 22, the number of ICs increases and thus cost is raised. Thus, we have to reduce the total number of address drivers IC to three fourth by electrically connecting the A electrodes 22 of the two blue unit luminescent areas EU(38B*a*) and EU(38B*b*) in the same pixel EG with each other and by assigning only one terminal of the corresponding address driver IC to the A electrodes 22 of the blue unit luminescent areas EU(38B*a*), EU(38B*b*) in the single pixel EG. To achieve this structure on the second substrate 21 of the PDP 1, however, electrode lines including grade-separated intersections have to be provided on the second substrate 21. Such lines are not technically impossible, but forming circuit wiring including grade-separated intersections on the inner surface of the second substrate 21 increases the process of thermal treatment to raise the cost, since the second substrate 21 is generally a glass substrate and the A electrodes 22 are formed of metal, i.e., the rear panel is formed of heat-resisting inorganic materials.

6-1. First Solution

For achieving inexpensive circuit wiring including grade-separated intersections, a first solution is to form such wiring within wiring of an address driver circuit board (e.g., printed wiring board) mounted on the rear panel of the PDP 1. An example is shown in FIG. 19 and an electrical connection therein will be described in the following.

On an address driver circuit board 57, for each pixel EG, a red signal wire (second signal wire) 55$R_1$, . . . , 55$R_{m-3}$ for transmitting a signal to be applied to the A electrode 22 of the red unit luminescent area EU(38R); a common blue signal wire (a single first signal wire) 55$B_2$, . . . , 55$B_{m-2}$ for transmitting a signal to be applied to the A electrodes 22 of the blue unit luminescent areas EU(38B*a*) and EU (38B*b*); and a green signal wire (second signal wire) 55$G_3$, . . . , 55$G_{m-1}$ for transmitting a signal to be applied to the A electrode 22 of the green unit luminescent area EU(38G) are extended from corresponding output terminals of each of a plurality of address drivers IC54 which are mounted on the board 57 to corresponding output terminals ($TA_1$, . . . , $TA_{m-3}$), ($TA_2$, . . . , $TA_{m-2}$), ($TA_3$, . . . , $TA_{m-1}$) which are mounted on the board 57. This board 57 features each blue signal wire 55$B_2$, . . . , 55$B_{m-2}$ that is branched on its way into a first blue signal wire (corresponding to one of branch signal lines) 55B$a_2$, . . . , 55B$a_{m-2}$ and a second blue signal wire (corresponding to the other of branch signal lines) 55B$b_4$, . . . , 55B$b_m$. Each of the second blue signal wires 55B$b_4$, . . . , 55B$b_m$ further forms a grade-separated intersection with the adjacent green signal wire 55$G_3$, . . . , 55$G_{m-1}$ on the board 57 and then extends in parallel with the adjacent green signal wire 55$G_3$, . . . , 55$G_{m-1}$ toward the corresponding output terminal $TA_4$, . . . , $TA_m$. This allows the A electrodes 22$_1$, . . . , 22$_m$ on the second substrate 21 to extend along the second direction D2 (FIG. 7) without forming a grade-separated intersection with each other. In FIG. 19, the reference numeral 56 designates a FPC board.

Figure 19:
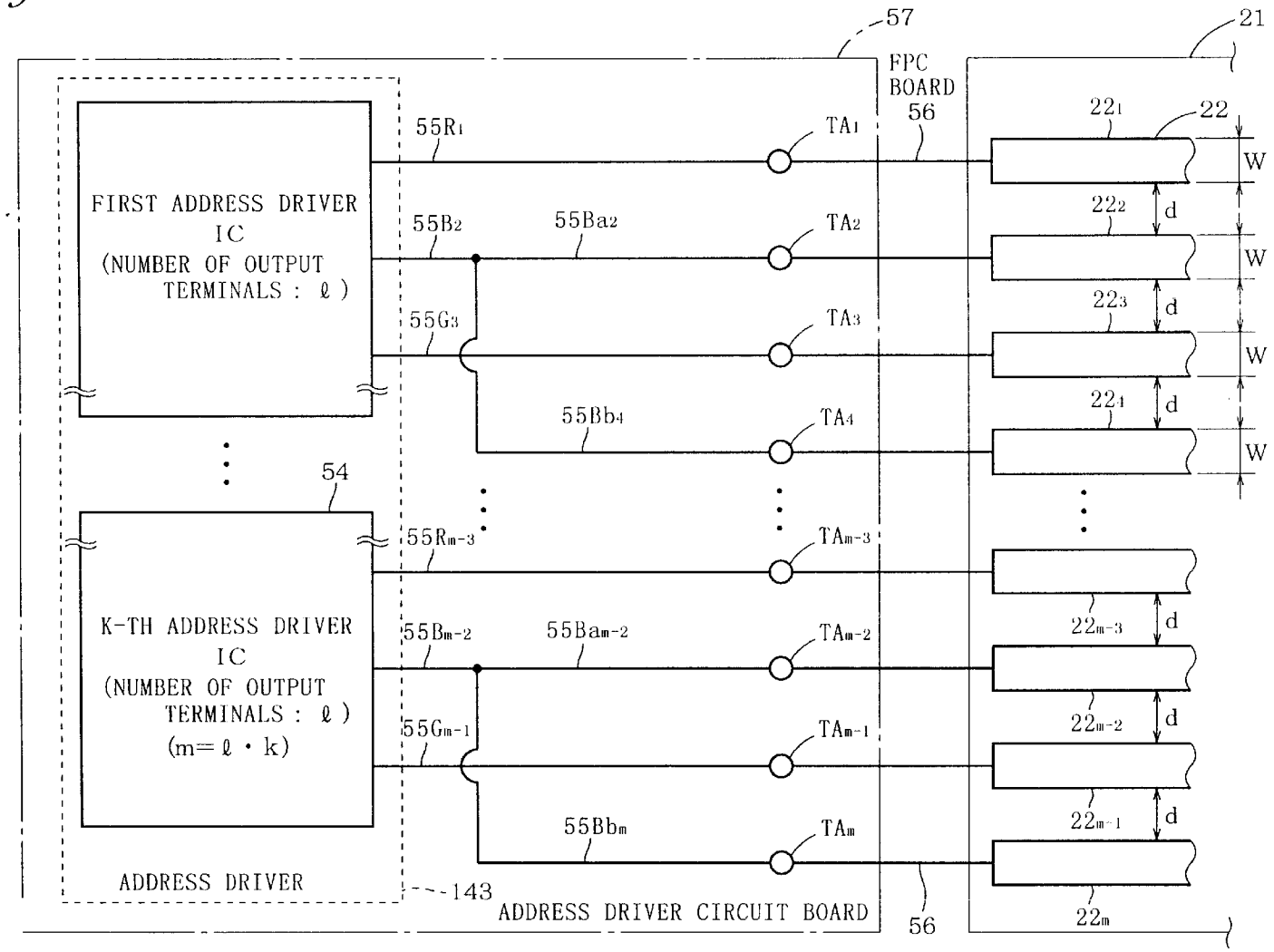
FIG. 19 is a block diagram showing an example of the structure by a first solution according to a sixth preferred embodiment.

On the address driver circuit board 57, the grade-separated intersections of the blue signal wires 55B$a_j$ (j is a multiple of 4) and the adjacent green signal wires 55$G_{j+1}$ as shown in FIG. 19 can be readily accomplished by forming the board 57 with a multilayer structure to utilize an electrical connection via through holes between multilayer; or by forming the board 57 with a double-sided wiring structure to utilize an electrical connection via through holes between front and rear surfaces.

In this fashion, none of lines relating to the A electrodes 22 on the second substrate 21 of the PDP 1 have to form grade-separated intersections with the lines on the FPC board 56 to establish an electrical isolation therebetween. Under this condition, the same signal can be outputted from the output terminals $TA_2$, $TA_4$, . . . , $TA_{m-2}$, $TA_m$ of the address driver circuit board 57 to the terminal portions of the A electrodes 22 corresponding to the blue unit luminescent areas EU(38B*a*) and EU(38B*b*) in the same pixel EG. This achieves an inexpensive and high color temperature PDP.

The concept of this solution is applicable not only to the example of FIG. 7 but also to any modifications of the second preferred embodiment. In this case, one of the branched blue signal lines is intersected with one or two other color signal line(s) (e.g., two for the color arrangement B-R-G-B).

6-2. Second Solution

Another solution is to provide a blue address driver circuit board and a red and green address driver circuit board on the respective end portions of the second substrate facing in the second direction. As an example, FIG. 20 schematically shows those circuit boards adopted to the PDP 1 of FIG. 7 which is illustrated with both a plate figure viewed from the top of the PDP and a block diagram on the side of the circuit board.

Figure 20:
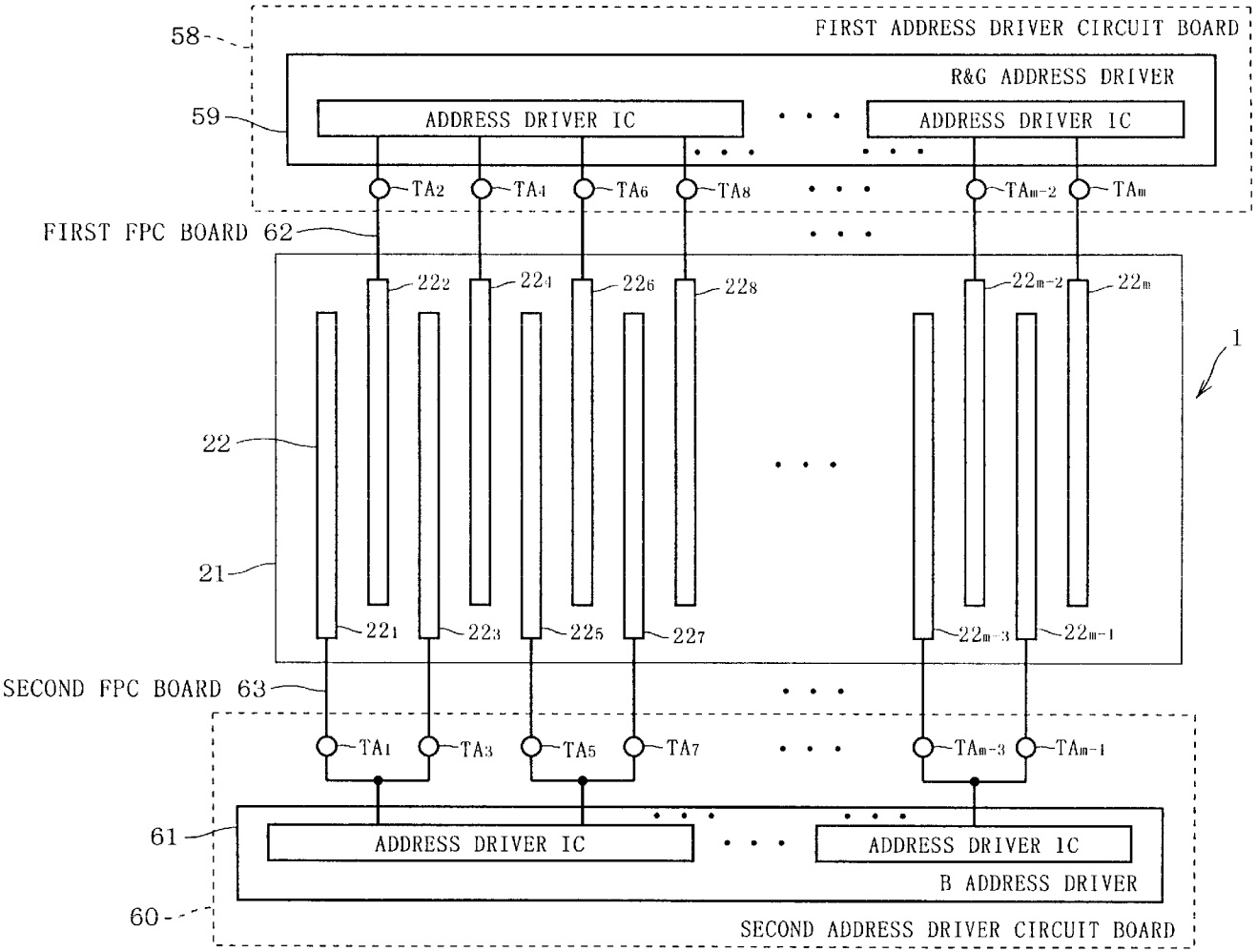
FIG. 20 shows an example of the structure by a second solution according to the sixth preferred embodiment.

In FIG. 20, the reference numeral 58 designates a first address driver circuit board for red and green on which an R&G address driver 59 (composed of at least one IC) is mounted. The board 58 is disposed outside one side surface of the second substrate 21 orthogonal to the second direction D2 where the exposed terminal portions of the A electrodes 22 corresponding to red and green are located. On the other hand, a second address driver circuit board 60 for blue is disposed outside the other side surface of the second substrate 21 where the exposed terminal portions of the A electrodes 22$_1$, 22$_3$, 22$_5$, 22$_7$, . . . , 22$_{m-3}$, 22$_{m-1}$ corresponding to the blue unit luminescent areas EU(38B*a*) and EU(38B*b*) are located. On the board 60, a B address driver 61 (composed of at least one IC) is mounted, and each output terminal of the driver 61 is assigned to two A electrodes 22 {(22$_1$, 22$_3$), (22$_5$, 22$_7$), . . . , (22$_{m-3}$, 22$_{m-1}$)} of the two blue unit luminescent areas EU(38B*a*) and EU(38B*b*) in a single pixel. The signal wire extending from each output terminal of the driver 61 on the board 60 is branched on its way and connected to the corresponding output terminals $TA_1$, $TA_{m-3}$, . . . , $TA_{m-3}$, $TA_{m-1}$ thereby to correspond to each A electrode 22 of the two blue unit luminescent areas EU(38B*a*) and EU(38B*b*) in the same pixel EG.

This method increases the number of address driver circuit boards, but considerably simplifies the structure of wiring on the first and second address driver circuit boards 58 and 60 as compared with the example of FIG. 19.

6-3. Modifications

Figure 21:
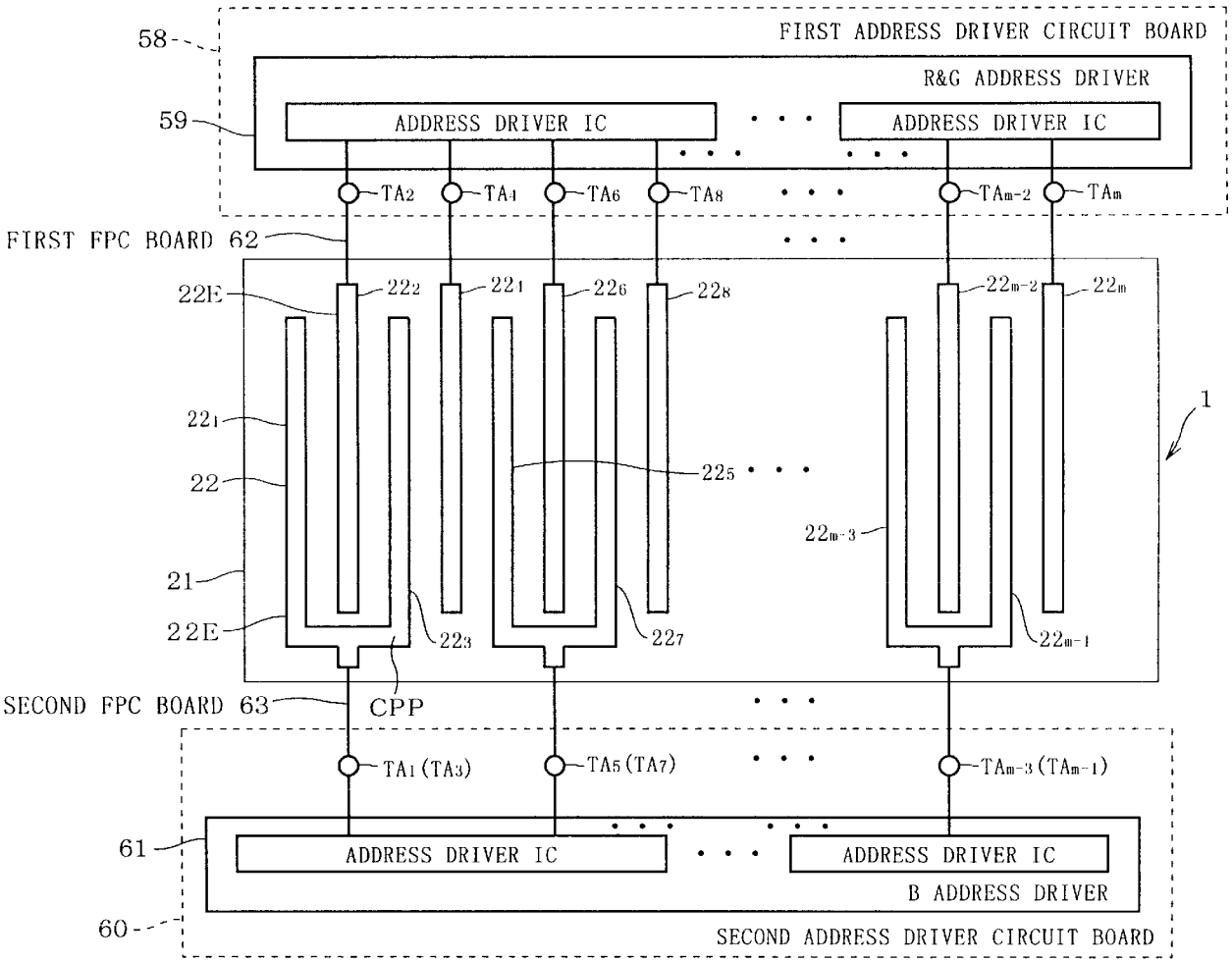
FIG. 21 shows a modified structure by the second solution according to the sixth preferred embodiment.

As an alternative to the structure of FIG. 20, as shown in FIG. 21, the terminal portions 22E of the A electrodes 22 corresponding to the blue unit luminescent areas EU(38B*a*) and EU(38B*b*) may be electrically connected to each other via a connecting pattern portion CPP at the end portion of the second substrate 21 of the PDP 1 so that each output terminal of the B address driver 61 can be electrically connected to the corresponding connecting pattern portion CPP of the A electrodes 22 via an FPC board 63. In this case, only the connecting pattern portions CPP are needed on the second substrate 21 without grade-separated intersections of the A electrodes 22. Further, the cost of forming the connecting pattern portions CPP is so small that it may be ignored.

This second solution is also applicable to any other modifications of the second preferred embodiment.

7. Seventh Preferred Embodiment

A seventh preferred embodiment improves the second preferred embodiment.

When the emitted colors of the unit luminescent areas are arranged in order of B, G, B, R, B, G, B, R . . . (see FIG. 12), for example, four unit luminescent areas arranged in order of B, G, B, R are regarded as a single pixel in display. Here in order to improve resolution of plasma display devices by this display technique, further increased accuracy is required in panel fabrication as compared with the fabrication of the plasma display device with the conventional PDP of FIG. 31. Nevertheless, the improvement in the resolution of display devices is expected in the market. Therefore, it becomes necessary to improve the resolution of the PDP 1 of the second preferred embodiment without losing the effect and increasing accuracy in panel fabrication.

In applications requiring natural image displays such as received images in telecast or movie images, it is more important to display video images as natural images with high resolution than to display fine characters or graphics faithfully.

Figure 22:
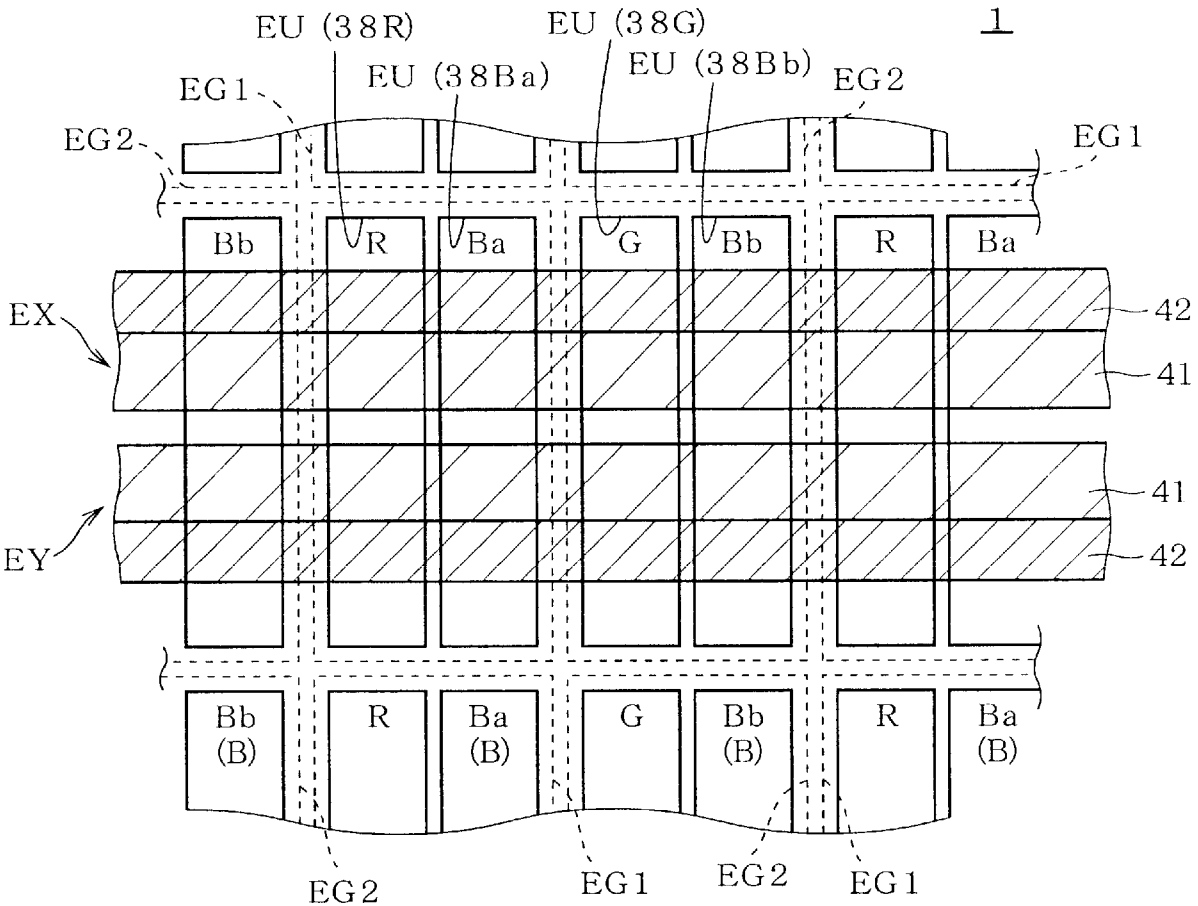
FIG. 22 is a perspective top view schematically showing an example of a pixel structure in a PDP according to a seventh preferred embodiment.

We consider that the aforementioned improvement in resolution can be made by developing the function to display video images as natural images. For this, as shown in the perspective enlarged plan view of FIG. 22, a set of two unit luminescent areas EU(38R) and EU(38B*a*) arranged in order of R, B (corresponding to a first group) and a set of two unit luminescent areas EU(38G) and EU(38B*b*) arranged in order of G, B (corresponding to a second group) is regarded as a display area of a single pixel, respectively. When considering that RGB color luminance signals for 1280 pixels in a horizontal direction (first direction D1) are fed to the PDP 1 having 640 R-B-G-B arrangements in the horizontal direction, for example, the inputted luminance signals are allotted to two kinds of pixels: EG1 with the color arrangement R-B and EG2 with the color arrangement G-B, for display. For display of the pixel EG1 with the color arrangement R-B, for example, only red and blue luminance signals are used without using a green luminance signal. Similarly, for display of the pixel EG2 with the color arrangement G-B, only green and blue luminance signals are used without using a red luminance signal. In this technique, only two third of the originally inputted luminance signals are used for the display of each pixel EG1, EG2, i.e., a lack of color, so that each pixel does not display a right color. However, since video images are in most cases composed of a smooth sequence of signals, the issue here is whether the whole subject can be faithfully displayed as one object or not, rather than accuracy in display of each pixel. Therefore, even if the above pixel structure in FIG. 22 is adopted to the PDP 1 of the second preferred embodiment (cf. FIGS. 7, 9 through 14), an image recognized by the naked eye by synthesizing all pixel displays is natural. The structure rather increases effective resolution, achieving a high-resolution video image. In addition, the structure of the PDP 1 of the second preferred embodiment allows bluish white color displays without increasing deterioration in phosphors and sacrificing red and green gradations.

8. Eighth Preferred Embodiment

An eighth preferred embodiment overcomes a new problem caused by the adoption of the first preferred embodiment. We will now give a detailed description of the problem.

In the first preferred embodiment, as shown in FIG. 1, all the A electrodes have almost the same width in the first direction D1 irrespective of the widths of the unit luminescent areas EU in the first direction D1.

However, as the discharge space 30 of the unit luminescent area EU becomes wider with the increased width of the area EU in the first direction D1, a discharge starting voltage in that discharge space 30 is lowered. This causes unit luminescent areas EU to have a different optimum applied voltage, resulting in difficulty in driving. In the driving method illustrated in FIG. 30, for example, when the voltage of the address pulse n2 during the address period is lower than its optimum value, incomplete address discharge is induced, which causes a problem that cells to be lightened are not lightened (insufficient writing).

Conversely, when the voltage of the address pulse n2 is higher than its optimum value, discharge is induced only by wall charges at the falling edge of the address pulse n2 (so called "self-erase discharge"). Since wall charges are erased by this self-erase discharge, the same problem arises that cells to be lightened are not lightened (self-erasing).

Accordingly, when each color unit luminescent area EU has a different width in the first direction D1, insufficient writing is likely to occur in a relatively narrow unit luminescent area because the increase in the discharge starting voltage relatively leads to a shortage of the address pulse voltage. In a relatively wide unit luminescent area, on the other hand, self-erasing is likely to occur because the decrease in the discharge starting voltage relatively leads to an excess of the address pulse voltage.

That is, the application of the appropriate address pulse voltage becomes impossible in all the unit luminescent areas, causing either insufficient writing or self-erasing.

In this eighth preferred embodiment, thus, the width of the A electrode in the first direction becomes narrower as the width of the unit luminescent area in the first direction increases. This allows each unit luminescent area to have almost the same optimum applied voltage irrespective of its width in the first direction.

Now, we will give a detailed description of this improvement adopted to the PDP 1 of the first preferred embodiment.

Figure 23:
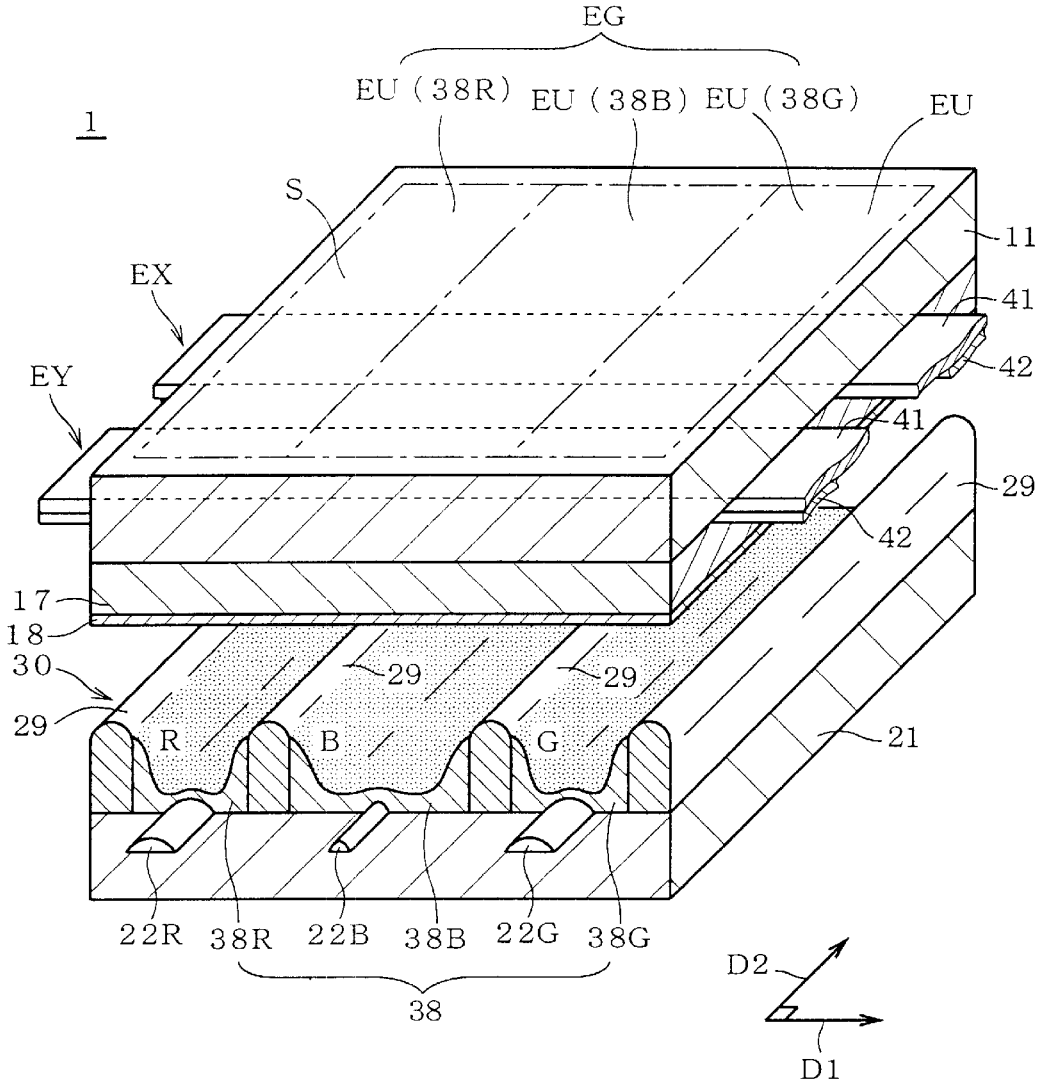
FIG. 23 is a perspective view showing an example of a PDP according to an eighth preferred embodiment.

FIG. 23 is a perspective showing a sectional structure of a single pixel in the PDP 1 according to the eighth preferred embodiment.

In the PDP 1 of FIG. 23, the blue unit luminescent area EU(38B) is wider in the first direction D1 than the red and green unit luminescent areas EU(38R) and EU(38G) as in the PDP 1 of the first preferred embodiment. The reference characters 22R, 22G, and 22B are A electrodes in the red, green, and blue unit luminescent areas EU, respectively. The width of the A electrode 22B in the blue unit luminescent area EU(38B) is smaller than that of the A electrodes 22R and 22G in the red and green unit luminescent areas EU(38R) and EU(38G).

Since the blue unit luminescent area EU(38B) is larger in size than the red and green unit luminescent areas EU(38R) and EU(38G), the discharge starting voltage in a portion of the discharge space 30 corresponding to the blue unit luminescent area EU(38B) is lower than the other portions corresponding to the other colors. Accordingly, during address operation, the optimum address pulse voltage in the blue unit luminescent area EU(38B) becomes lower than that in the red and green unit luminescent areas EU(38R) and EU(38G).

The narrower the width of the A electrode 22, the weaker the electric field strength becomes in the discharge space 30 when the address pulse is applied to the A electrode 22. The condition is substantially equivalent to the case where the address pulse voltage is set at a low level.

In FIG. 23, therefore, the width of the A electrode 22 in the blue unit luminescent area EU(38B) is intentionally set narrower than those of the other color A electrodes 22 in order to modify the optimum address pulse voltage. Thus, even if a constant address pulse voltage is applied to each A electrode 22, address operation in each unit luminescent area EU can be performed under nearly optimum conditions.

The concept of the PDP 1 in FIG. 23 is basically applicable to such a common case that each unit luminescent area has a different width in the first direction D1. More specifically, while, in the above example, the blue unit luminescent area EU(38B) is formed wider in the first direction D1 than the red and green unit luminescent areas EU(38R) and EU(38G), the ratio of the widths of the unit luminescent areas corresponding to the respective emitted colors may be determined in consideration of various conditions as previously described in the first preferred embodiment. In that case, the width of the A electrode 22 becomes smaller with the increase in the width of the unit luminescent area EU in the first direction D1.

In this fashion, even if each unit luminescent area EU has a different width in the first direction D1, it is possible to avoid both insufficient writing due to the decrease in the applied address pulse voltage and self-erasing due to the increase in the address pulse voltage. Accordingly, a stable display screen with no flicker can be obtained.

9. Ninth Preferred Embodiment

A ninth preferred embodiment proposes a technique for overcoming a new problem caused by the adoption of the PDP 1 of the first preferred embodiment.

When the unit luminescent area of a certain color becomes wider in the first direction than the unit luminescent areas of the other colors, another problem has come up. That is, when address discharge occurs in a narrower unit luminescent area, unnecessary discharge also occurs in the adjacent wider unit luminescent area.

Figure 24:
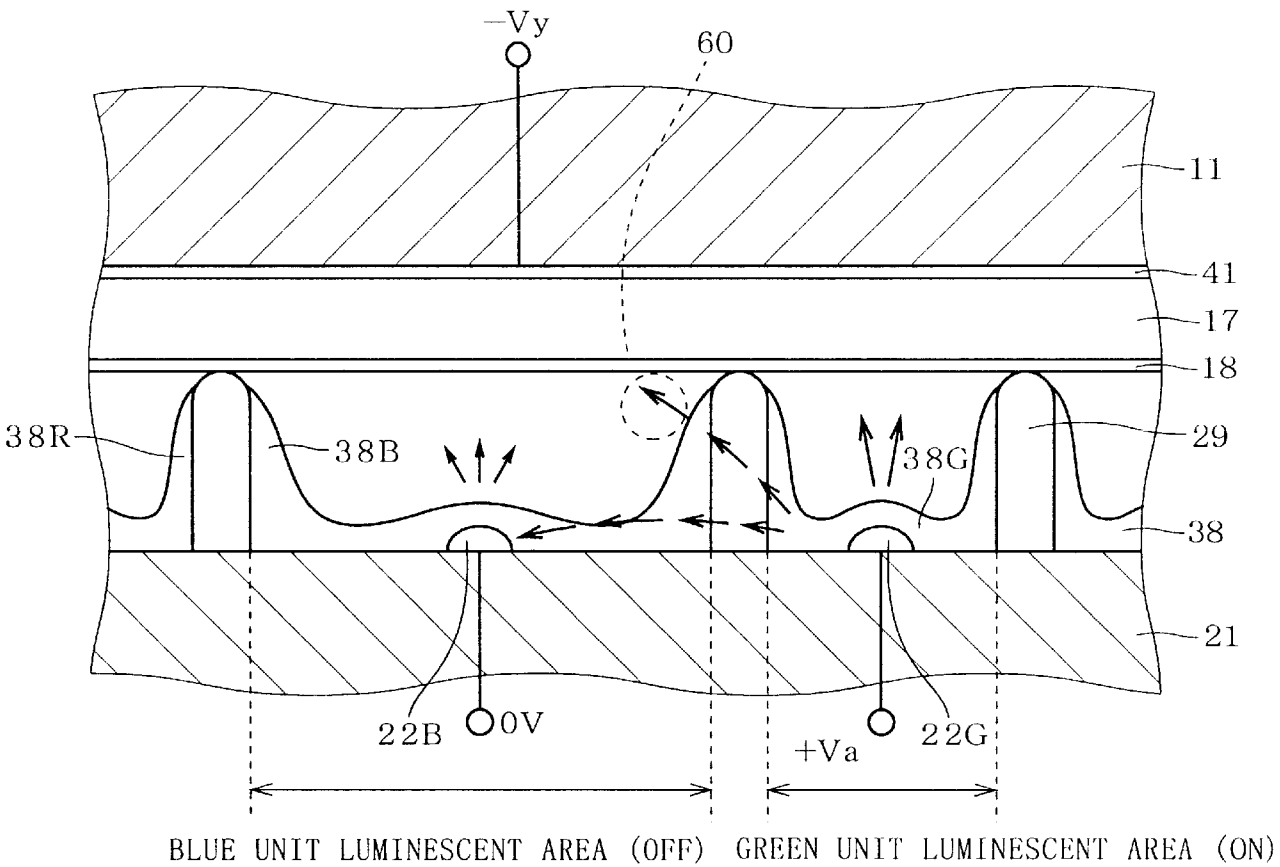
FIG. 24 is a longitudinal cross-sectional view that illustrates a problem with the PDP of the first preferred embodiment.

We will describe this problem with reference to FIG. 24. FIG. 24 is a cross-sectional view taken along the Y electrode out of the pair display electrodes X and Y, i.e., an electrode to which the scan pulse n1 is applied in FIG. 30, which schematically shows an electric field during the address period. In FIG. 24, the directions and the lengths of arrows schematically show the direction and the strength of the electric field, respectively. Further, a wider unit luminescent area in the first direction (blue unit luminescent area in this case) is in the off (non-luminescence) state; and the adjacent green unit luminescent area is in the on (luminescence) state.

Here, the address pulse (voltage+Va) and the scan pulse (voltage−Vy) are applied to the A electrode 22G in the on-state unit luminescent area and the Y electrode 41, respectively, which produces a strong electric field between the A electrode 22G and the Y electrode 41 and thus induces address discharge. On the other hand, the voltage of the A electrode 22B in the off-state unit luminescent area is kept at 0 V and thus only a weak electric field occurs, so that address discharge is not induced under normal operating conditions. However, in some cases, leakage of the electric filed from the A electrode 22G in the adjacent on-state unit luminescent area may cause a strong electric filed in the end portion of the off-state unit luminescent area (surrounded by a broken line 60 in FIG. 24) and thereby unnecessary discharge (or error of discharge) may occur in the intrinsically off-state unit luminescent area. Especially when the off-state unit luminescent area is a relatively wide unit luminescent area (blue unit luminescent area in this case), errant discharge is more likely to occur because, in that area, the discharge starting voltage is low and the A electrode has a relatively narrower width than those in the other unit luminescent areas, which poorly functions as a guard against the electric field.

Thus, in the ninth preferred embodiment as opposed to the eight preferred embodiment, the width of A electrode becomes wider with the increase in the width of the unit luminescent area in the first direction.

Figure 25:
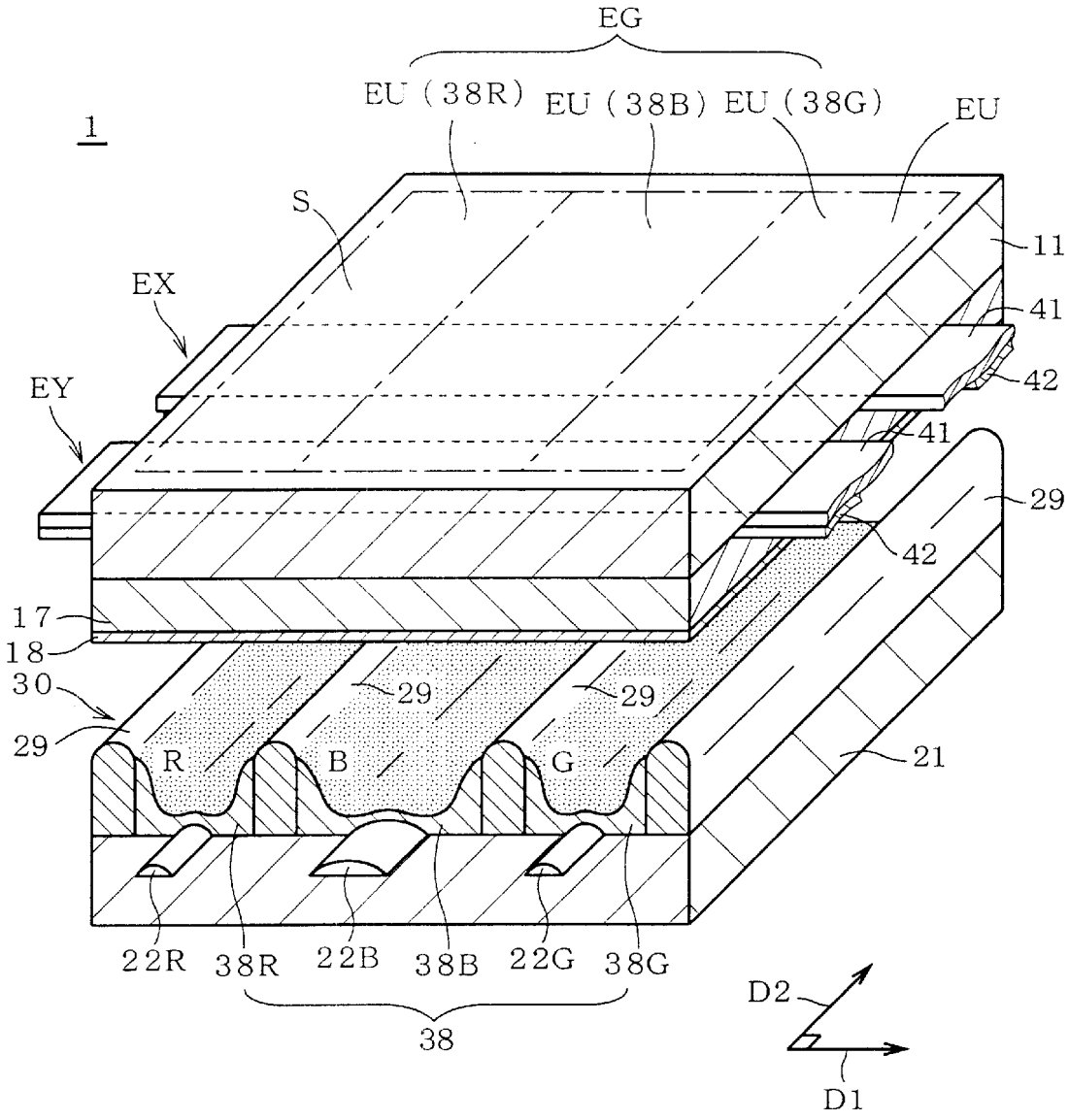
FIG. 25 is a perspective view showing an example of a PDP according to a ninth preferred embodiment.

FIG. 25 is a perspective view showing a section structure of a single pixel in the PDP 1 according to the ninth preferred embodiment. In the PDP 1 of FIG. 25, the blue unit luminescent area EU(38B) is formed wider in the first direction D1 than the red and green unit luminescent areas EU(38R) and EU(38G) as in the PDP 1 of the first preferred embodiment. The reference characters 22R, 22G, and 22B are A electrodes in the red, blue, and green unit luminescent areas EU, respectively. The width of the A electrode 22B in the blue unit luminescent area EU(38B) is greater than that of the A electrodes 22R and 22G in the red and green unit luminescent areas EU(38R) and EU(38G).

Figure 26:
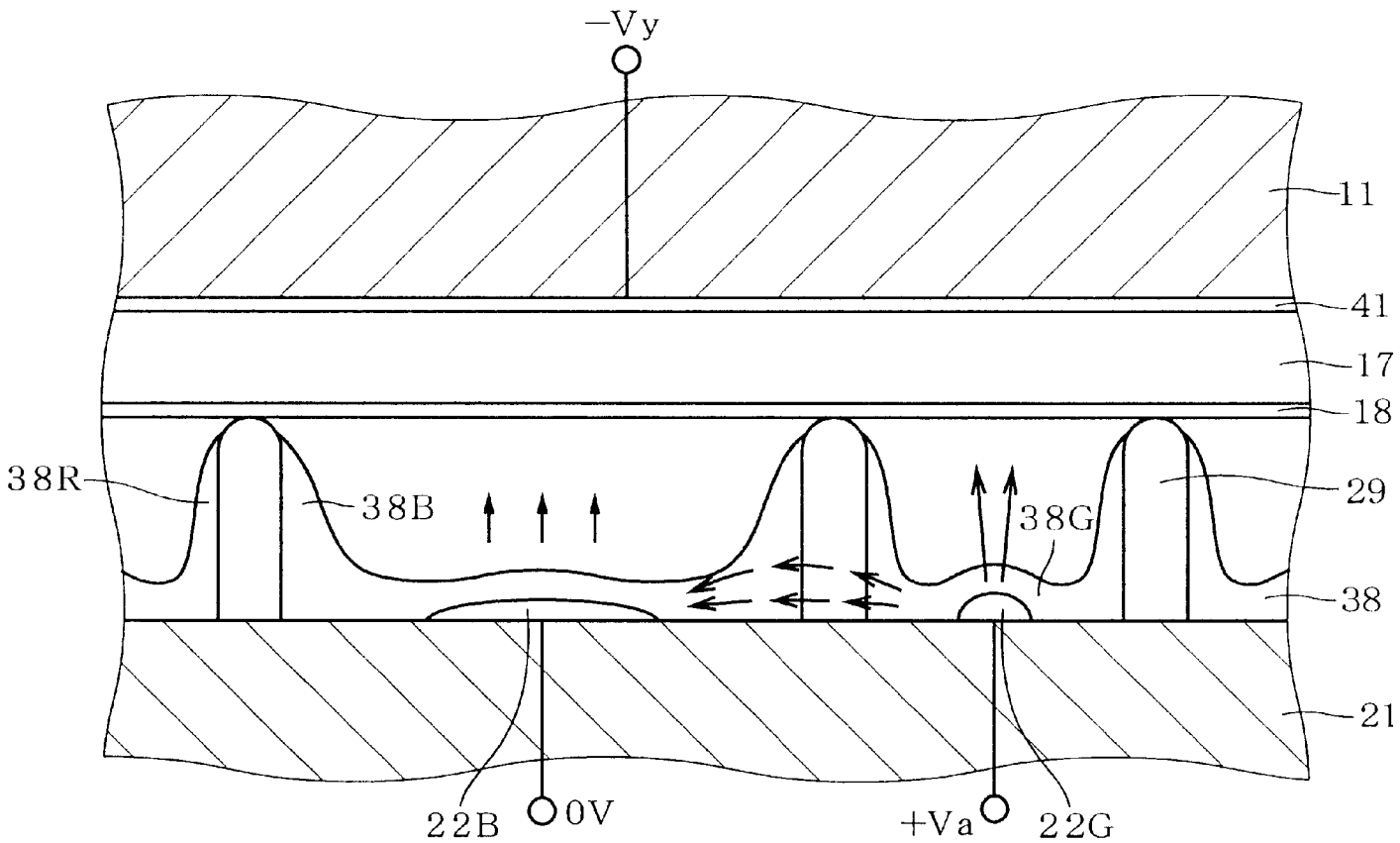
FIG. 26 is a longitudinal cross-sectional view schematically showing the function of the PDP according to the ninth preferred embodiment.

FIG. 26 is a cross-sectional view taken along the Y electrode EY in the PDP 1 of FIG. 25, schematically showing an electric field during the address period. Similar to the case of FIG. 24, a relatively wide unit luminescent area (blue unit luminescent area in this case) is in the off (non-luminescence) state, and the adjacent green unit luminescent area is in the on (luminescence) state in FIG. 26. As shown in FIG. 26, leakage of the electric field from the A electrode 22G in the adjacent green unit luminescent area is drawn into the A electrode 22B in the blue unit luminescent area which is widened as compared with that in FIG. 24, so that a strong electric field does not occur in the discharge space of the blue unit luminescent area. Alternatively, only a weak electric filed produced by the A electrode 22B kept at 0 V remains (this phenomenon is referred to as "guard function against electric field by the wide A electrode").

The concepts of the structures in FIGS. 25 and 26 are applicable to such a case that each unit luminescent area has a different width in the first direction. In that case, also, we can avoid the problem that when address discharge occurs in a narrow unit luminescent area, unnecessary discharge also occurs in the adjacent wide unit luminescent area.

In the above description, the blue unit luminescent area EU(38B) is wider in the first direction D1 than the red and green unit luminescent areas EU(38R) and EU(38G), but as previously described in the first preferred embodiment, the ratio of the widths of the unit luminescent areas corresponding to the respective emitted colors may be determined in consideration of various conditions. In that case, the A electrode should be formed wider with the increase in the width of the unit luminescent area EU in the first direction D1.

Which is to be more critical issue, address failure or discharge in the wrong area, depends on various conditions such as the kind of gas filling the discharge space, the height of the barrier ribs, flatness of the top portions of the barrier ribs, and alignment accuracy of the A electrodes. That is, as to the widths of the A electrodes 22, we can select either of the following according to what is to be the most critical issue: (1) to increase with the increase in width of the unit luminescent area EU in the first direction D1 as described in this preferred embodiment; (2) to decrease with the increase in the width of the unit luminescent area EU in the first direction D1 as described in the eighth preferred embodiment; or (3) to have the same width in all the unit luminescent areas in order to give priority to ease of fabrication.

10. Tenth Preferred Embodiment

A tenth preferred embodiment resolves a new problem caused by the adoption of the PDP 1 of the first preferred embodiment and the modified PDPs of the third through fifth, eighth, and ninth preferred embodiments.

In the aforementioned preferred embodiments, any of the red, blue and green phosphors 38R, 38B, and 38G fully cover the side walls of the barrier ribs 29 up to the portions in the vicinity of the protective layer 18. Such a structure, however, brings a new problem of a narrow viewing angle of the PDP 1. Specifically, consider an opening angle θ (see FIG. 27 which will be referred to later) between the visual line of an observer who sees light emissions of the red, blue and green phosphors 38R, 38B and 38G through the first substrate 11, and a direction D3 perpendicular to the display surface S on a plane perpendicular to the barrier ribs 29. As the opening angle θ increases, larger part of the red (R), blue (B), and green (G) phosphors 38R, 38B, and 38G are shaded by the barrier ribs 29 and thus luminescence intensity of each phosphor is reduced. As to the blue phosphor 38B, since a space between barrier ribs 29 on both sides is larger than that of the other color phosphors, reduction in the luminescence intensity with the increase in the opening angle θ progresses gently as compared with the red and green phosphors 38R and 38G. Therefore, as the opening angle θ increases, the balance of luminescence intensity between red, blue, and green shifts and the intensity of blue component in white color increases. This causes the problem of a narrow viewing angle.

The tenth preferred embodiment thus proposes the following improvements.

Figure 27:
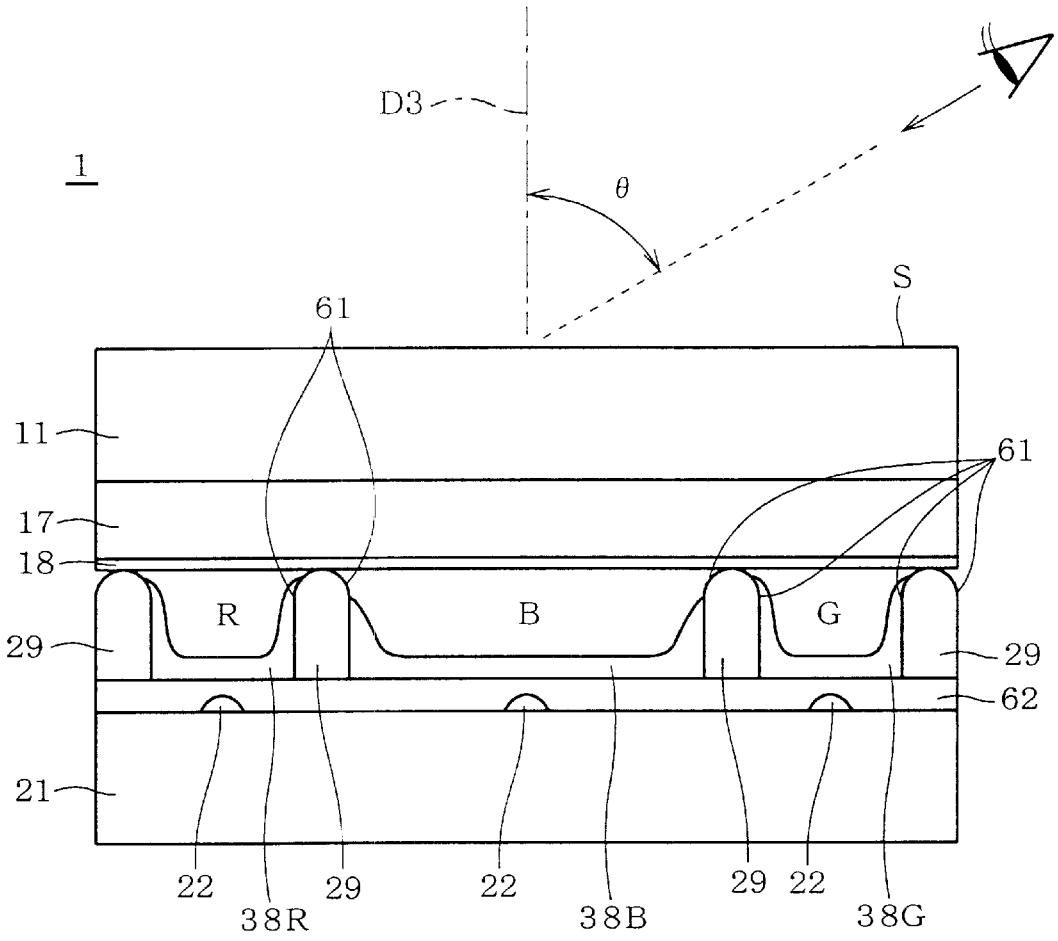
FIG. 27 is a longitudinal cross-sectional view showing an example of the structure of a PDP according to a tenth preferred embodiment.

FIG. 27 is a longitudinal cross-sectional view of a discharge cell structure of the PDP 1 according to the tenth preferred embodiment, taken along a plane perpendicular to a lead direction of the A electrodes 22. The same components as described with FIG. 1 are denoted by the same reference numerals or characters. The reference numeral 62 designates a graze layer which will be described later. As shown in FIG. 27, (1) a space between adjacent barrier ribs 29 sandwiching the blue phosphor (first phosphor) 38B is larger than that between adjacent barrier ribs 29 sandwiching the red or green phosphor (second phosphor) 38R or 38G; and (2) in the blue unit luminescent area (first unit luminescent area), the blue phosphor 38B does not cover portions 61 of the side walls of the barrier ribs 29 in the vicinity of the protective layer 18. In the adjacent red and green unit luminescent areas (second unit luminescent area), as in the conventional case, the red and green phosphors 38R and 38G cover the side walls of the barrier ribs 29 from its bottom to the portions 61 in the vicinity of the protective layer 18.

With the aforementioned features (1) and (2), the tenth preferred embodiment makes it possible to balance the reduction in the luminescence intensity of blue and the reduction in the luminescence intensity of red and green, which are all associated with the increase the opening angle θ. This improves display characteristics when viewed from an oblique angle.

In FIG. 27, the blue phosphor 38B does not cover the portions 61 of the side walls of the barrier ribs 29 in the vicinity of the protective layer 18. Alternatively, the blue phosphor 38B may cover the portions 61 but lightly so that the luminescence intensity of blue in those portions 61 becomes relatively low as compared with that in the other portions of the same unit luminescent area. In that case, as to the portions 61 of the side walls of the barrier ribs 29 in the vicinity of the protective layer 18, the thickness of the blue phosphor 38B on those portions 61 is essentially smaller than that of the red and green phosphors 38R and 38G on those portions 61.

As described so far, in the tenth preferred embodiment, ① a space between adjacent barrier ribs sandwiching the blue phosphor is larger than that between adjacent barrier ribs sandwiching the red or green phosphor; and ② the blue phosphor is deposited relatively lightly on portions of the side surfaces of the barrier ribs in the vicinity of the protective layer. This allows the luminescence intensity of red, blur, and green when viewed from a direction perpendicular to the display surface to be balanced to a desired degree, and further improves the problem of a narrow viewing angle relating to the balance of the luminescence intensity of red, blue, and green.

Figure 28:
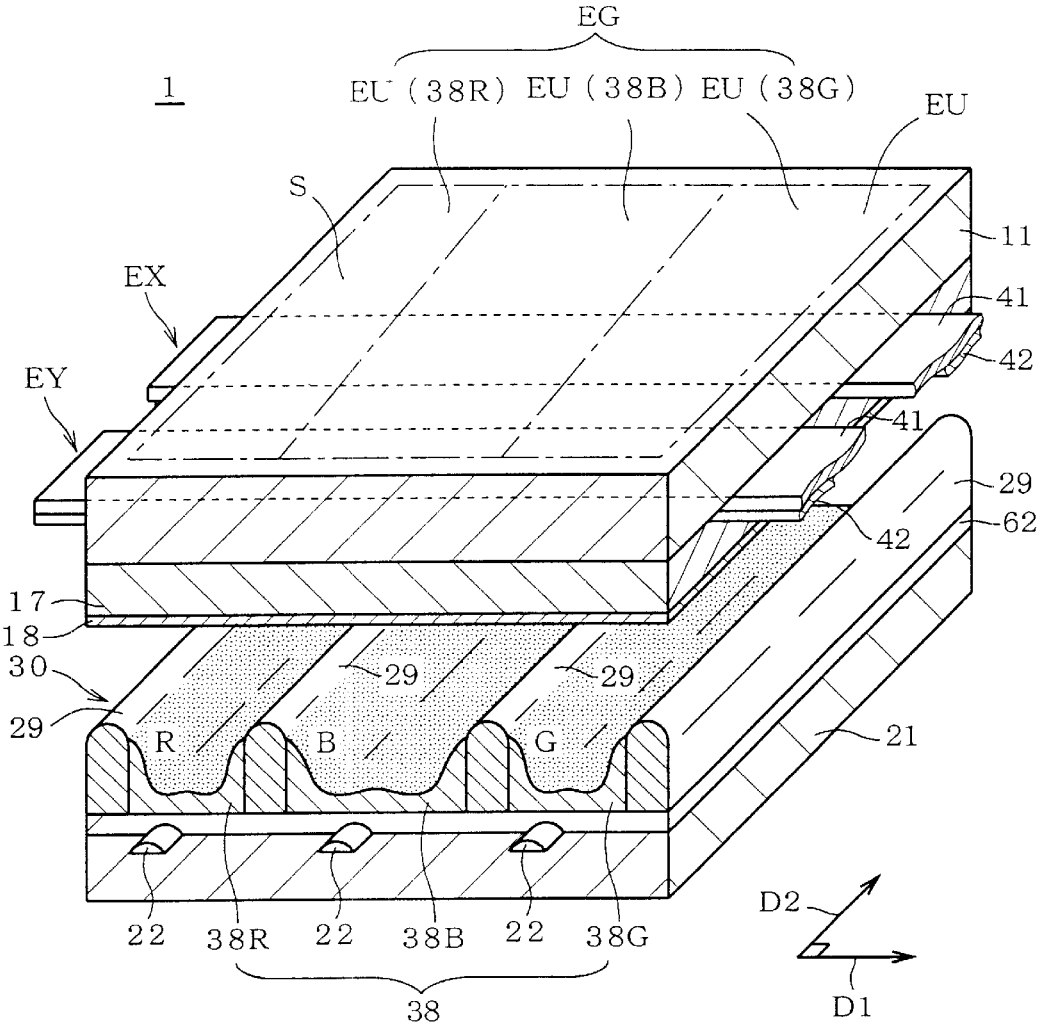
FIG. 28 is a perspective view showing an example of common modifications to the first to tenth preferred embodiments.

11. Common Modifications to First to Tenth Preferred Embodiments (1) In the first through tenth preferred embodiments, the barrier ribs and the phosphors are formed on the inner surface of the second substrate as shown in FIGS. 1, 7, 23, and 25, but after a dielectric layer (graze layer) for covering the inner surface of the second surface and the A electrode formed on the inner surface (except the vicinity of the terminal portions of the A electrode) are provided as an underlying layer, the barrier ribs and the phosphors may be formed on a surface of the underlying layer. Such a modification to the PDP 1 of FIG. 1 is, for example, shown in FIG. 28. In FIG. 28, the reference numeral 62 designates the above dielectric layer. The dielectric layer 62 prevents migration of materials of the A electrodes 22 and functions as a reflective layer of lights emitted from the phosphors.

In consideration of this modification as well as the other examples, "the second substrate" can be defined in a broad sense as follows. That is, when the PDP 1 includes the dielectric layer 62, a portion composed of the elements 21, 22, and 62 corresponds to "the second substrate," and "the surface or inner surface of the second substrate" corresponds to the surface of the dielectric layer 62. When the PDP 1 includes no dielectric layer 62 as shown in FIG. 1, on the other hand, the first substrate 21 with the A electrodes 22 corresponds to "the second substrate" and the surface of the substrate 21 corresponds to "the surface or inner surface of the second substrate."

(2) The technical features described in the first through tenth preferred embodiments are applicable to PDPs and PDP devices which comprise a first group of barrier ribs spaced in the first direction and a second group of barrier ribs spaced in the second direction, each forming a grade-separated intersection with each of the former barrier ribs. In this case (2), the first and second groups of barrier ribs are both formed on "the surface of the second substrate" which is defined in the foregoing common modification (1), and a height of a barrier rib belonging to the second group is equal to or less than that of a barrier rib belonging to the first group.

(3) Further, the technical features described in the first through tenth preferred embodiments are of course applicable to PDPs and PDP devices in which the top portions of the barrier ribs on "the second substrate" are not in direct contact with the surface of the protective layer on the first substrate.

While the invention has been described in detail, the foregoing description is in all aspects illustrative and not restrictive. It is understood that numerous other modifications and variations can be devised without departing from the scope of the invention.

We claim:

1. A surface discharge type plasma display panel comprising:

a first substrate;

a plurality of display electrode pairs formed on an inner surface of said first substrate in a first direction;

a second substrate with a plurality of address electrodes formed in a second direction intersecting with said first direction, said second substrate and said first substrate sandwiching a discharge space therebetween;

a plurality of phosphors provided for each of said plurality of address electrodes to emit a plurality of emitted colors; and a plurality of barrier ribs extending in said second direction on said second substrate and spaced in said first direction so that a substantial space corresponding to at least any one emitted color out of said plurality of emitted colors is different from a space corresponding to the other emitted colors, each of said plurality of barrier ribs having side walls on which each of said plurality of phosphors are deposited.

2. The surface discharge type plasma display panel of claim 1, wherein said second substrate comprises:

a second substrate body;

said plurality of address electrodes formed on said second substrate body; and a dielectric formed on said second substrate and on said plurality of address electrodes to cover said plurality of address electrodes, and said plurality of barrier ribs are formed on a surface of said dielectric.

3. The surface discharge type plasma display panel of claim 2, wherein said plurality of emitted colors include red, green, and blue.

4. The surface discharge type plasma display panel of claim 3, wherein said any one emitted color is blue.

5. The surface discharge type plasma display panel of claim 1, said surface discharge type plasma display panel composed of a plurality of pixels each including unit luminescent areas each corresponding to each of said plurality of emitted colors, wherein a substantial space between barrier ribs corresponding to said any one emitted color is larger than one third the width of any one pixel out of said plurality of pixels in said first direction.

6. The surface discharge type plasma display panel of claim 1, said surface discharge type plasma display panel composed of a plurality of pixels each including unit luminescent areas each corresponding to each of said plurality of emitted colors, wherein a substantial space between barrier ribs corresponding to said any one emitted color is about twice a space between barrier ribs corresponding to a given emitted color other than said any one emitted color.

7. The surface discharge type plasma display panel of claim 1, wherein said plurality of emitted colors include red, green, and blue;

a phosphor of said red, a phosphor of said green, and a phosphor of said blue are defined as "R", "G", and "B", respectively;

a single pixel is composed of four unit luminescent areas; and phosphors in said single pixel are arranged in order of R, B, G, B in said first direction.

8. The surface discharge type plasma display panel of claim 1, wherein said plurality of emitted colors include red, green, and blue;

a phosphor of said red, a phosphor of said green, and a phosphor of said blue are defined as "R", "G", and "B", respectively;

a single pixel is composed of four unit luminescent areas; and phosphors in said single pixel are arranged in order of B, G, B, R in said first direction.

9. The surface discharge type plasma display panel of claim 1, wherein a color temperature obtained by mixing said plurality of emitted colors is approximately 9300 K or more.

10. A surface discharge type plasma display device comprising:

said surface discharge type plasma display panel of claim 1; and a driving control system, said driving control system comprising:

display-electrode driving circuits connected to a first electrode and a second electrode, respectively, said first and second electrodes forming each of said plurality of display electrode pairs of said surface discharge type plasma display panel, said display-electrode driving circuits configured to drive said surface discharge type plasma display panel;

an address-electrode driving circuit connected to said plurality of address electrodes of said surface discharge type plasma display panel; and a control unit configured to control said display-electrode driving circuits and said address-electrode driving circuit.

11. The surface discharge type plasma display device of claim 10, further comprising:

a filter provided forward of a substrate on a display surface side of said surface discharge type plasma display panel out of said first and second substrates and having a spectrum that transmittance of each wavelength is almost uniform in a visible luminescence wavelength region.

12. The surface discharge type plasma display panel of claim 1, wherein a substrate on a display surface side of said surface discharge type plasma display panel out of said first and second substrates is colored and has a spectrum that transmittance of each wavelength is almost uniform in a visible luminescence wavelength region.

13. The surface discharge type plasma display panel of claim 4, further comprising:

a dielectric layer formed on said inner surface of said first substrate to cover said plurality of display electrodes; and a filter provided in a portion of said dielectric layer corresponding to a cell of said blue emitted color and having a spectrum that transmittance of a blue light wavelength is higher than transmittance of a red light wavelength.

14. The surface discharge type plasma display panel of claim 1, wherein a first unit luminescent area corresponding to said any one emitted color and a second unit luminescent area corresponding to one of said other emitted colors are adjacent to each other in said first direction;

a space between barrier ribs defining said first unit luminescent area is larger than a space between barrier ribs defining said second unit luminescent area;

one of said barrier ribs defining said first unit luminescent area corresponds to one of said barrier ribs defining said second unit luminescent area, having a first side wall on the side of said first unit luminescent area and a second side wall on the side of said second unit luminescent area; and a thickness of a first phosphor covering a portion of said first side wall in the vicinity of said inner surface of said first substrate is smaller than a thickness of a second phosphor covering a portion of said second side wall in the vicinity of said inner surface of said first substrate.

15. The surface discharge type plasma display panel of claim 1, wherein of said plurality of address electrodes, a width of an address electrode of an unit luminescent area corresponding to said any one emitted color in said first direction is different from widths of address electrodes of unit luminescent areas corresponding to said other emitted colors in said first direction.

16. The surface discharge type plasma display panel of claim 15, wherein with an increase in said substantial space between barrier ribs defining said unit luminescent area of said any one emitted color, said width of said address electrode corresponding to said any one emitted color becomes narrower than said width of said address electrodes corresponding to said other emitted colors.

17. The surface discharge type plasma display panel of claim 15, wherein with an increase in said substantial space between barrier ribs defining said unit luminescent area of said any one emitted color, said width of said address electrode corresponding to said any one emitted color becomes wider than said width of said address electrodes corresponding to said other emitted colors.

18. The surface discharge type plasma display panel of claim 1, wherein of said plurality of address electrodes, a width of an address electrode of an unit luminescent area corresponding to any one emitted color out of the plurality of emitted colors in the first direction is about the same as widths of address electrodes of unit luminescent areas corresponding to the other emitted colors in the first direction.

19. The surface discharge type plasma display panel of claim 15, wherein each of said plurality of address electrodes, except for its terminal portions connected outside, is located about at a center between adjacent barrier ribs corresponding each said address electrode out of the plurality of barrier ribs; and respective terminal portions of said plurality of address electrodes are sequentially formed at regular intervals on an end portion of the second substrate.

20. The surface discharge type plasma display panel of claim 1, wherein a single pixel comprises at least four unit luminescent areas;

wherein of the plurality of address electrodes in the single pixel, a terminal portion of an address electrode of an unit luminescent area corresponding to any one emitted color out of the plurality of emitted colors is provided on one end portion of said second substrate; and terminal portions of address electrodes of unit luminescent areas corresponding to the other emitted colors are provided on an other end portion of the second substrate, the one end portion and the other end portion of the second substrate being in an inverse relationship with respect to the second direction.

21. The surface discharge type plasma display panel of claim 20 wherein any two of the at least four unit luminescent areas which are sequentially arranged in the first direction correspond to a blue emitted color.

22. The surface discharge type plasma display panel of claim 21, wherein four unit luminescent areas comprise:

a first group including two unit luminescent areas of the blue emitted color and of a red emitted color; and a second group including two unit luminescent areas of the blue emitted color and of a green emitted color, wherein said first and second groups form a display area for a single pixel.

23. The surface discharge type plasma display panel of claim 10, wherein said plurality of emitted colors is composed of at least three colors;

said surface discharge type plasma display panel comprises a plurality of pixels;

each of the plurality of pixels comprises at least four unit luminescent areas, wherein two of the at least four unit luminescent areas correspond to any one emitted color out of the plurality of emitted colors;

said address-electrode driving circuit comprises an address-electrode driving circuit board equipped with an address driver;

wherein for each pixel, of output terminals of the address driver, an output terminal of any one emitted color out of the plurality of emitted colors is electrically connected to a first end portion of a first signal line, said signal line branched into two branch signal lines, on the address-electrode driving circuit board, and respective output terminals of said other emitted colors are electrically connected to corresponding first end portions of second signal lines which extend without intersecting each other, on said address-electrode driving circuit board; and wherein one of said two branch signal lines forms a grade-separated intersection with at least one of the adjacent second signal lines, and respective second end portions of the first and second signal lines are electrically connected to corresponding terminal portions of the plurality of address electrodes.

24. The surface discharge type plasma display panel of claim 10, wherein a gradation level for each of said plurality of emitted colors is approximately the same.

25. A surface discharge type plasma display panel comprising:

a first substrate;

a group of display electrodes formed on an inner surface of said first substrate in a first direction;

a second substrate with a group of address electrodes arranged successively in said first direction and each extending in a second direction intersecting with said first direction, said second substrate and said first substrate sandwiching a plurality of discharge spaces therebetween; and a plurality of phosphors provided for each of address electrodes in said group of address electrodes, on a portion of an inner surface of said second substrate facing a discharge space corresponding to each of said address electrodes, each of said plurality of phosphors emitting light of color corresponding to each of said address electrodes, each phosphor extending in said second direction together with a corresponding address electrode, wherein a substantial luminescent area corresponding to at least any one emitted color out of a plurality of emitted colors is different in size from substantial luminescent areas corresponding to the other emitted colors, and a substantial luminescent area corresponding to a blue emitted color has a maximum size.

26. The surface discharge type plasma display panel of claim 25, wherein said emitted colors are composed of red, green, and blue; and a substantial luminescent area of said blue is larger than substantial luminescent areas of said red and said green.

27. A substrate for a surface discharge type plasma display panel, comprising:

a plurality of barrier ribs spaced in a first direction on a surface of said substrate and extending in parallel with each other in a second direction intersecting with said first direction; and a plurality of phosphors each formed on facing side walls of adjacent barrier ribs out of said plurality of barrier ribs and on a portion of said surface of said substrate sandwiched between said adjacent barrier ribs, each phosphor emitting a light of either of a plurality of emitted colors, said each phosphor extending in said second direction together with a corresponding adjacent barrier ribs, wherein a substantial area of a portion between said adjacent barrier ribs covered with a phosphor corresponding to at least any one emitted color out of said plurality of emitted colors is different in size from substantial areas of portions covered with phosphors corresponding to the other emitted colors, and a substantial area corresponding to a blue emitted color has a maximum size.

28. The substrate according to claim 27, further comprising:

a plurality of address electrodes provided for each portion of said surface of said substrate sandwhiched between said corresponding adjacent barrier ribs and each extending in said second direction, wherein a first address electrode out of said plurality of address electrodes, which corresponds to said phosphor of said at least any one emitted color, has a first width in said first direction different in size from widths in said first direction of address electrodes corresponding to said phosphors of said other emitted colors.

* * * * *